US012228356B2

(12) United States Patent
Johns et al.

(10) Patent No.: US 12,228,356 B2
(45) Date of Patent: Feb. 18, 2025

(54) DEVICE FOR CLEANING INNER SURFACE OF HEAT EXCHANGER TUBES

(71) Applicant: Tubemaster, Inc., Louisville, KY (US)

(72) Inventors: Clifford L Johns, Louisville, KY (US); Dennis Patrick McAndrews, Jeffersonville, IN (US); Stephen W Brewer, New Albany, IN (US)

(73) Assignee: Tubemaster, Inc., Louisville, KY (US)

( * ) Notice: Subject to any disclaimer, the term of this patent is extended or adjusted under 35 U.S.C. 154(b) by 856 days.

(21) Appl. No.: 17/220,283

(22) Filed: Apr. 1, 2021

(65) Prior Publication Data

US 2021/0310756 A1 Oct. 7, 2021

Related U.S. Application Data

(60) Provisional application No. 63/142,015, filed on Jan. 27, 2021, provisional application No. 63/006,166, filed on Apr. 7, 2020.

(51) Int. Cl.

| | |
|---|---|
| ***F28G 1/16*** | (2006.01) |
| ***B24C 3/06*** | (2006.01) |
| ***B24C 3/16*** | (2006.01) |
| ***B24C 3/32*** | (2006.01) |
| ***B24C 5/04*** | (2006.01) |

(Continued)

(52) U.S. Cl.

CPC ..... *F28G 1/163* (2013.01); *B24C 3/062* (2013.01); *B24C 3/325* (2013.01); *B24C 3/327* (2013.01); *B24C 5/04* (2013.01); *B24C 7/0053* (2013.01); *B24C 7/0061* (2013.01); *F28G 15/003* (2013.01); *B24C 3/16* (2013.01); *B24C 5/02* (2013.01); *B24C 7/0046* (2013.01)

(58) Field of Classification Search

CPC .. B24C 3/06; B24C 3/062; B24C 3/16; B24C 3/32; B24C 3/325; B24C 3/327; B24C 5/02; B24C 5/04; B24C 7/0046; B24C 7/0053; B24C 7/0061; B08B 9/053; B08B 9/0321; B08B 9/0323; F28G 1/163; F28G 15/003; F28G 15/02; F28G 15/04; F28D 2021/0022; F28D 7/16

See application file for complete search history.

(56) References Cited

U.S. PATENT DOCUMENTS 6,725,706 B2 * 4/2004 Johns ..... B01J 8/008 702/140
7,789,966 B2 * 9/2010 Kramer ..... F28G 1/163 451/36

(Continued)

*Primary Examiner* — Makena S Markman
(74) *Attorney, Agent, or Firm* — Duncan Galloway Greenwald PLLC; Kevin T. Duncan

(57) ABSTRACT

A grit blasting arrangement for cleaning chemical reactor tubes includes means for ensuring the grit blast nozzle is coaxial with the longitudinal axis of the tube to be cleaned. The grit blasting device for cleaning tubes spaced apart by upper and lower tubesheets. The grit blasting device includes a grit blast nozzle mounted on a positioning frame and projecting outwardly with an outlet directed into a tube opening during a cleaning operation. The device includes a plurality of stop pins mounted on the positioning frame designed to abut a tubesheet and to define an imaginary plane coplanar with the tubesheet. The plurality of stop pins when abutting the tubesheet prevent the outlet of the nozzle from extending into the tube causing a venturi effect.

12 Claims, 37 Drawing Sheets

(51) Int. Cl.

| | |
|---|---|
| ***B24C 7/00*** | (2006.01) |
| ***F28G 15/00*** | (2006.01) |
| *B24C 5/02* | (2006.01) |

(56) References Cited

U.S. PATENT DOCUMENTS

| | | | | |
|---|---|---|---|---|
| 9,034,110 | B2 * | 5/2015 | Johns | F28G 1/12 134/22.18 |
| 9,205,391 | B2 * | 12/2015 | Johns | B01J 4/002 |
| 10,048,027 | B2 * | 8/2018 | Eisermann | F28D 7/103 |
| 2004/0035445 | A1 * | 2/2004 | Saxon | B08B 9/0321 134/8 |
| 2008/0142045 | A1 * | 6/2008 | Johns | B01J 8/0025 134/21 |
| 2018/0281030 | A1 * | 10/2018 | Eisermann | B01D 29/66 |

* cited by examiner

DEVICE FOR CLEANING INNER SURFACE OF HEAT EXCHANGER TUBES

BACKGROUND

This application claims priority from U. S. Provisional Application Ser. No. 63/006,166 filed Apr. 7, 2020, and from Ser. No. 63/142,015, which are hereby incorporated herein by reference.

The present invention relates to an arrangement for cleaning the inner surface of heat exchanger tubes, such as the tubes used in a chemical reactor or other type of heat exchanger. More specifically, it relates to a device for automated, hands-free, grit-blast cleaning the inner surface of the tubes.

Many chemical reactors are essentially large shell and tube heat exchanger vessels, with the reaction occurring inside the tubes and a coolant circulating in the vessel outside the tubes. Some chemical reactions occur in furnace or reformer tubes, which may be a part of a system with from 10 to 5,000 or more such tubes. In any of these reactor vessels, catalyst, typically in the form of pellets, may be loaded into the reactor to facilitate the reaction. The catalyst is replaced periodically.

The reactor tubes may be quite long, housed in a structure several stories tall. In order to replace the catalyst, the old, spent catalyst first must be removed from the reactor tubes. The inner surface of the tubes is then mechanically cleaned to remove any scale formed during the chemical reaction process, as this scale impedes or retards the reaction by slowing down the heat transfer rate.

As discussed in more detail below, the prior art method for removing this scale involves a person clad in protective gear physically pushing the end of a pressurized air hose against one end of a tube to be cleaned. The user presses a button or lever to initiate the flow of grit-laden pressurized air into the tube and holds it there for a long enough period of time to ensure that the inner surface of the tube is thoroughly cleaned. This task is dirty, tiresome, and prone to mistakes which may damage the tube being cleaned. For instance, if the user gets the axis of the nozzle spraying the grit-laden air misaligned with the axis of the tube being cleaned, he can erode the wall of the tube, even to the point of creating a hole through the wall.

SUMMARY

The present invention relates to an arrangement for grit blasting the scale off of the inner surface of reactor tubes in a relatively clean, controlled environment, reducing the opportunity for damage to the reactor tube, and creating a consistent, repeatable cleaning procedure.

An embodiment of the present invention provides a device to mechanically bring the grit blasting nozzle toward the end of the reactor tube and accurately orient the grit blasting nozzle at the end of the reactor tube(s) to be grit blasted without allowing high pressures to build up inside the reactor tube.

DESCRIPTION

Figure 1:
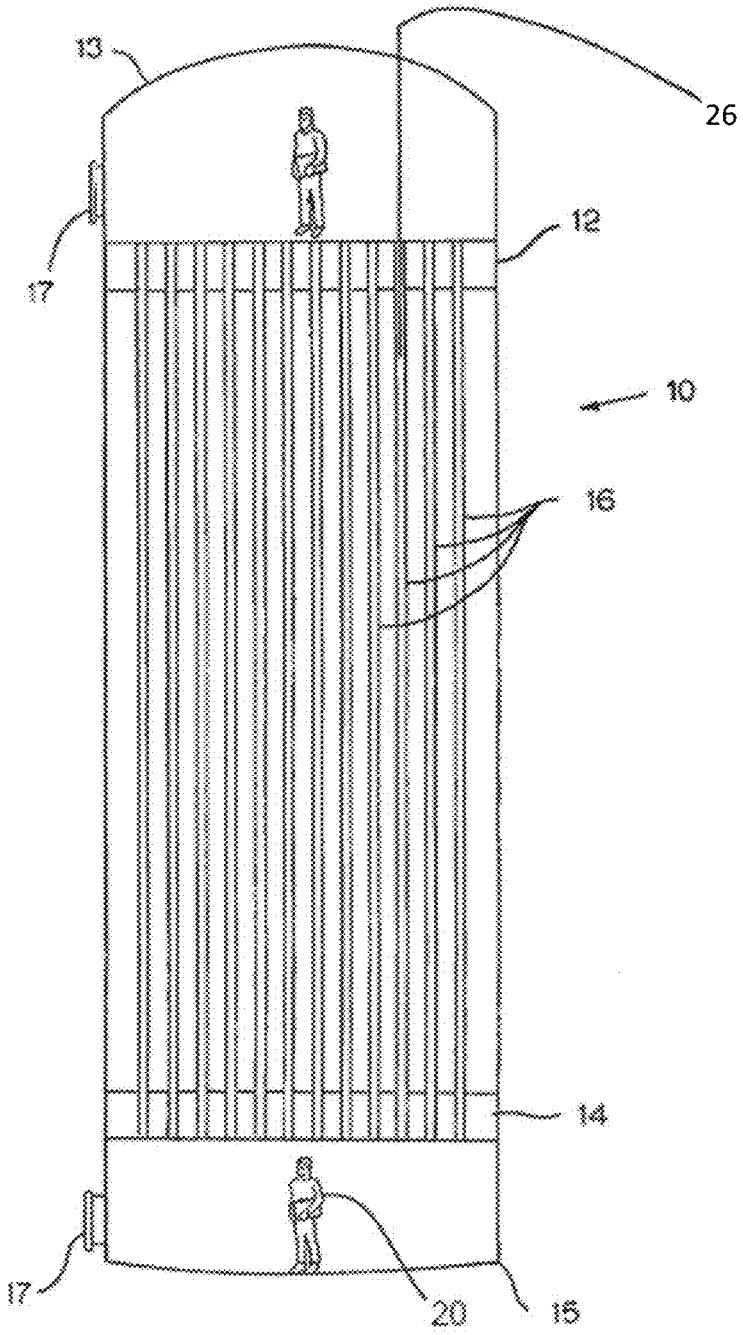
FIG. 1 is a schematic, section view of a shell and tube type of chemical reactor.
Figure 2:
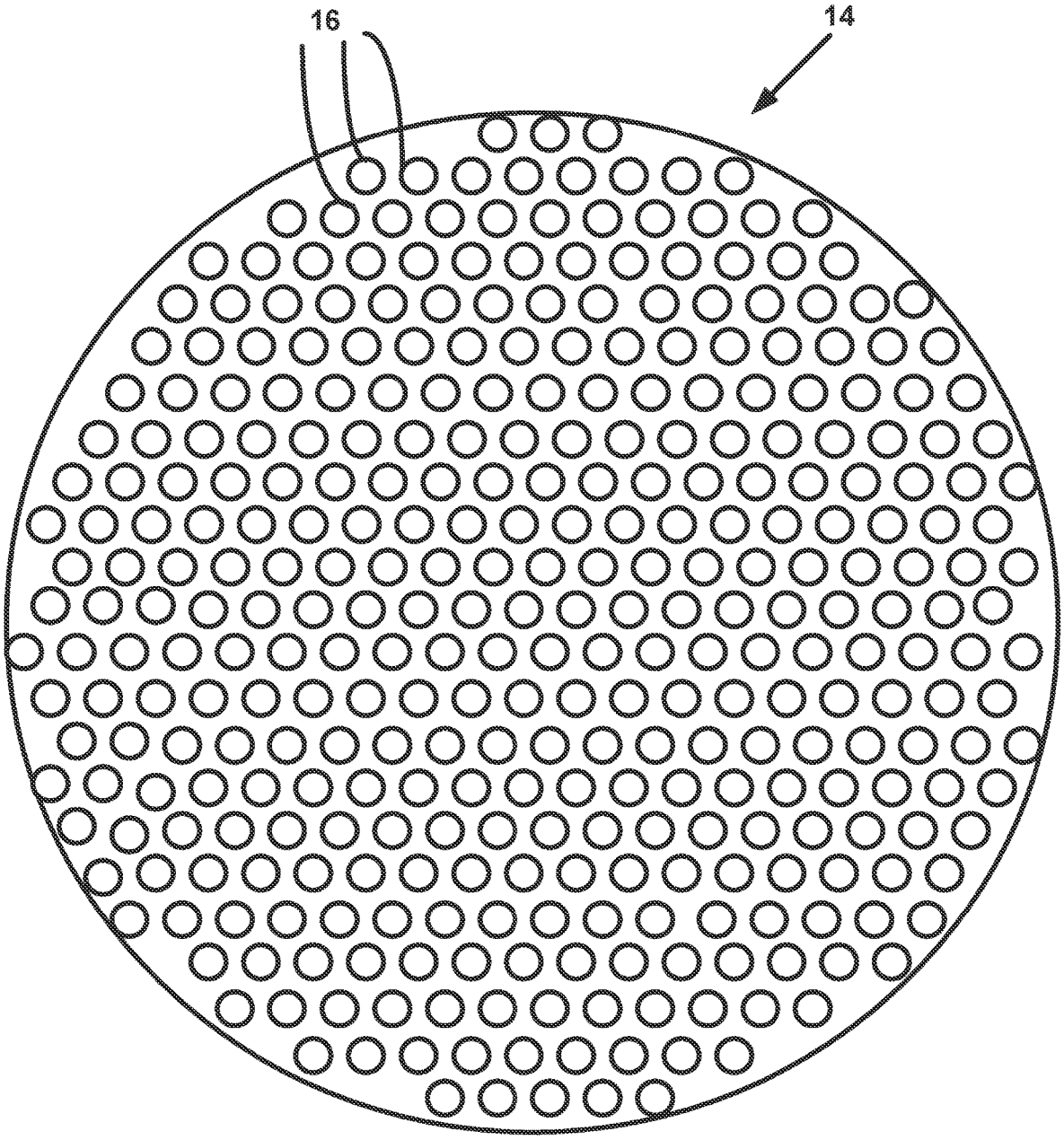
FIG. 2 is a bottom view of the lower tubesheet of the reactor vessel of FIG. 1.

FIG. 1 depicts a typical chemical reactor vessel 10, which is a shell and tube heat exchanger, having an upper tubesheet 12 and a lower tubesheet 14, with a plurality of vertical tubes 16 welded or expanded to the tubesheets 12, 14 to form a tightly packed tube bundle. There may be from one to many hundreds or even thousands of cylindrical tubes 16 (See also FIG. 2) extending between the tubesheets 12, 14. Each tube 16 has a top end secured to the upper tubesheet 12 and a bottom end secured to the lower tubesheet 14, and the tubes 16 are open at both ends, except that there may be a spring, clip or grid at the bottom end of each tube 16 to retain catalyst pellets inside the tube. The upper and lower tubesheets 12, 14 have openings that are the size of the outside diameter of the tubes 16, with each tube 16 being located in respective openings in the upper and lower tubesheets 12, 14.

The vessel 10 includes a top dome (or top head) 13 and a bottom dome (or bottom head) 15, as well as manways 17 for access to the tubesheets 12, 14 inside the vessel 10. The manways 17 are closed during operation of the reactor but are opened for access, such as during catalyst handling and tube cleaning operations. In this instance, the tubes 16 are filled with catalyst pellets, which facilitate the chemical reaction. (It may be noted that similarly-shaped shell and tube heat exchangers may be used for other purposes, such as for a boiler or other heat exchanger, and this arrangement may be used to clean the inner surface of those tubes as well.) Other pellets, such as filler pellets, also may be inside the tubes 16, and they are referred to herein as catalyst pellets as well.

Reactors have either fixed or removable heads. In this embodiment, the heads are fixed, and they include manways 17 at the top and at the bottom in order to provide access to their respective domes.

This particular reactor vessel 10 is fairly typical. Its tubes can range in length from 5 feet to 65 feet, and it is surrounded by a structural steel skid or framework (not shown), which includes stairways or elevators for access to the tubesheet levels of the reactor vessel 10 as well as access to intermediate levels, to a topmost level which may be located at or near the level of the top opening of the reactor vessel 10, and to a lower level which may be located at or near the level of the lower dome 15 of the reactor vessel 10. On a regular basis, which can be every 2 to 48 months or longer, as the catalyst becomes less efficient, less productive, or "poisoned", it is changed out, with the old catalyst being removed and a new charge of catalyst being installed in the tubes 16 of the reactor vessel 10. Catalyst handling also may have to be done on an emergency basis, on an unplanned and usually undesirable schedule.

A catalyst change operation involves a complete shutdown of the reactor, which may result in considerable cost due to lost production. It is desirable to minimize the amount of time required for the catalyst change operation in order to minimize the lost production and accompanying cost caused by the reactor shutdown as well as for other reasons.

Figure 3:
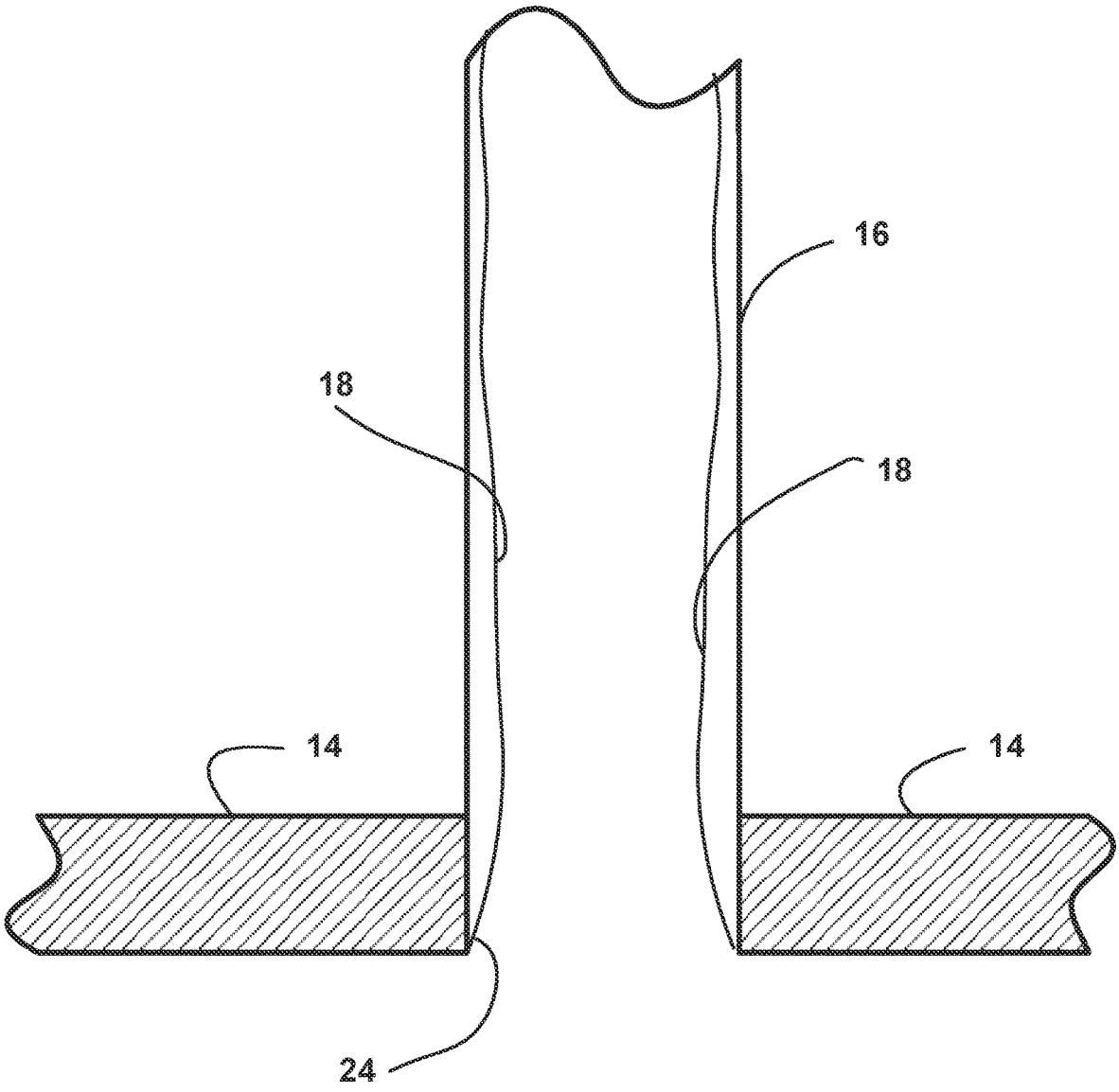
FIG. 3 is a broken away side sectional view of the bottom portion of a typical tube in the reactor vessel of FIG. 1, showing the scale formed on the inner surface of the tube.
Figure 4:
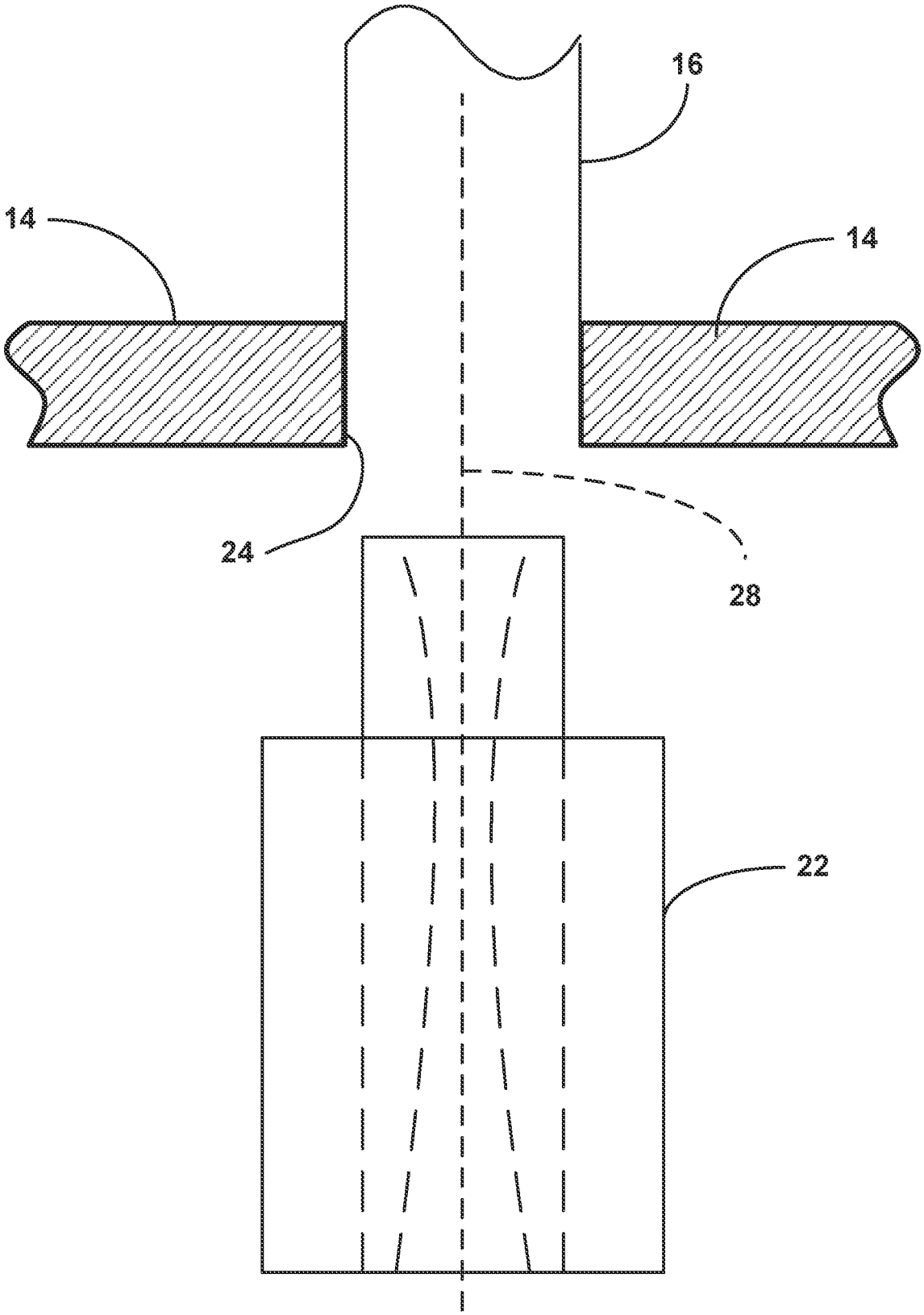
Fig 4 Prior Art
FIG. 4 is a partially broken-away, side sectional view of the reactor tube of FIG. 3, (with the scale removed for clarity) and a prior art nozzle for grit blasting the inner surface of the tube, just before the nozzle is inserted inside the tube.

Part of the catalyst change operation involves cleaning the inner surface of the reactor tubes 16 to remove any scale 18 (See FIG. 3) that may have formed inside the tubes 16. The scale 18 inhibits the heat transfer across the wall of the tubes 16, and it is therefore desirable to remove the scale 18 prior to reloading catalyst pellets inside the reactor tubes 16. This cleaning/removal of the scale 18 has traditionally been accomplished by having an operator 20 (See FIG. 1, not to scale), standing on the top tube sheet when grit blasting is to be from the top end of the tube, or with the operator standing in the bottom dome 15 or on a temporary service platform below the bottom tube sheet 14 when grit blasting is to be from the bottom end of the tube. Whether grit blasting is from the top or bottom, in the prior art, the operator physically rams the end of a nozzle 22 (See FIG. 4) into the top end or bottom end 24 of a reactor tube 16 (See also FIG. 5) and then turns on a flow of grit-laden compressed air (represented by the arrow 26) to flow through the nozzle 22 and into the tube 16 being cleaned.

Figure 5:
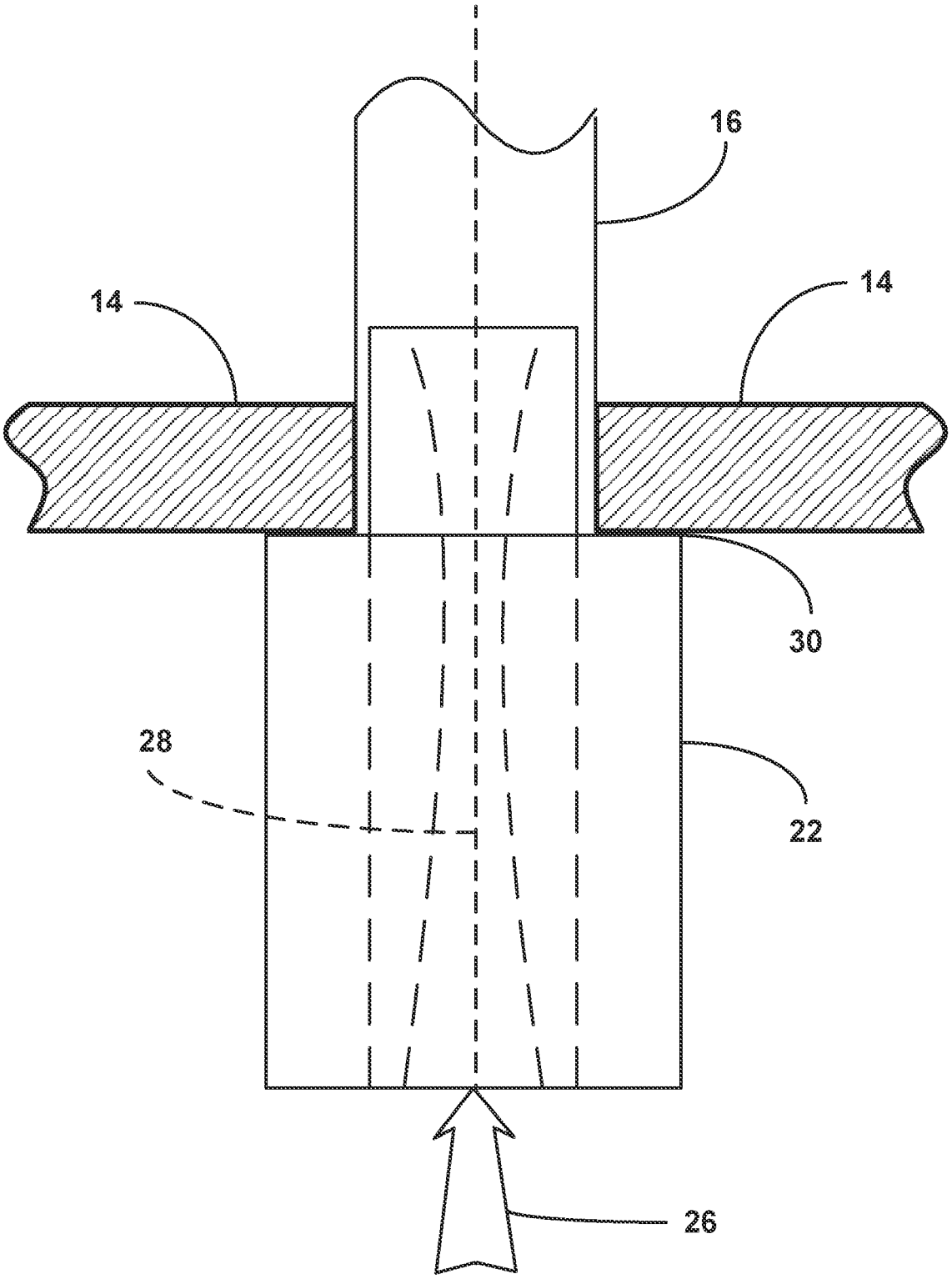
Fig 5 Prior Art
FIG. 5 is the same view as in FIG. 4 but with the prior art nozzle inserted into the bottom end of the reactor tube.

The following description refers to grit blasting from the bottom of the reactor tube 16 toward the top of the tube 16, as shown, for instance, in FIG. 5. However, it should be understood that the grit blasting procedure may be done from the top of the tube 16, blasting grit downwardly toward the bottom end of the tube 16. If the grit blasting procedure is to be done from the top of the tube towards the bottom of the tube, the hoses (such as the compressed air/grit conveying hoses) may be suspended from the top dome 13 (See FIG. 1).

Figure 6:
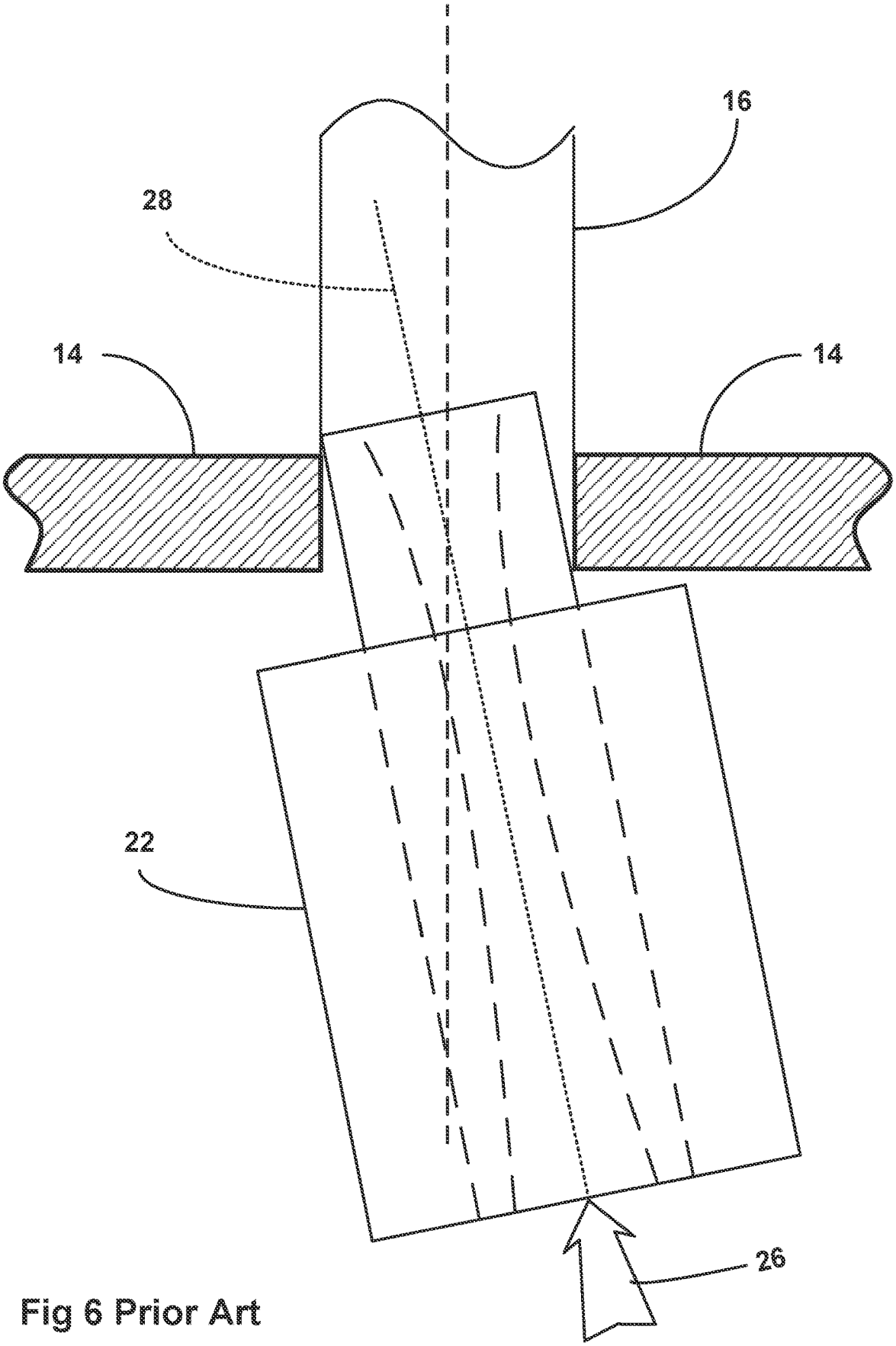
Fig 6 Prior Art
FIG. 6 is the same view as in FIG. 5 but with the prior art nozzle cocked at an angle showing the misalignment that may happen in the prior art arrangement.

Looking at FIG. 5, in the prior art, the goal of the operator 20 is to ram the nozzle 22 fully against the bottom tubesheet 14 so as to have the longitudinal axis 28 of the nozzle 22 coaxial with the longitudinal axis of the tube 16 in order to reduce misalignment as much as possible. FIG. 6 shows an example of misalignment, which causes severe erosion of the sidewall of the tube 16 in very short order and may even bore a hole through the sidewall of the tube, which is very undesirable.

Unfortunately, this type of misalignment is not unusual in the prior art. The operator 20 may not be paying close enough attention or may not even be aware that the nozzle 22 is misaligned. Imperfections in the surface of the tubesheet 14 in the area of the tube 16 to be cleaned, perhaps due to previous repairs, may result in the misalignment of the nozzle 22. Sometimes operators will purposely "jam" the nozzle at a bit of an angle by propping something against the nozzle and/or the hose which conveys the grit-laden compressed air 26 to the nozzle 22 in order to be able to take a "breather" while the tube is being cleaned. In fact, it has happened that the operator 20 forgets he has propped the grit-laden compressed air 26 in the on position as he goes to take a lunch break, only to return to a major disaster.

If the nozzle 22 is properly oriented with respect to the tube 16, with the longitudinal axis of the nozzle 22 coaxial with the longitudinal axis of the tube 16, as the operator 20 pushes the nozzle 22 against the bottom tubesheet 14, as shown in FIG. 5, he closes off any opening 30 between the nozzle 22 and the surface of the tubesheet 14. If the tube 16 is blocked (by scale or for any other reason, such as fused catalyst which has not been detected and removed), air pressure may build up very quickly inside the tube 16, with the pressurized air having no opening 30 through which to escape. The operator then may lose control of the nozzle 22 as the rising air pressure inside the tube causes the nozzle 22 to be ejected suddenly and with great force, spewing grit-laden compressed air 26 in an uncontrolled manner, which is very undesirable.

Figure 7:
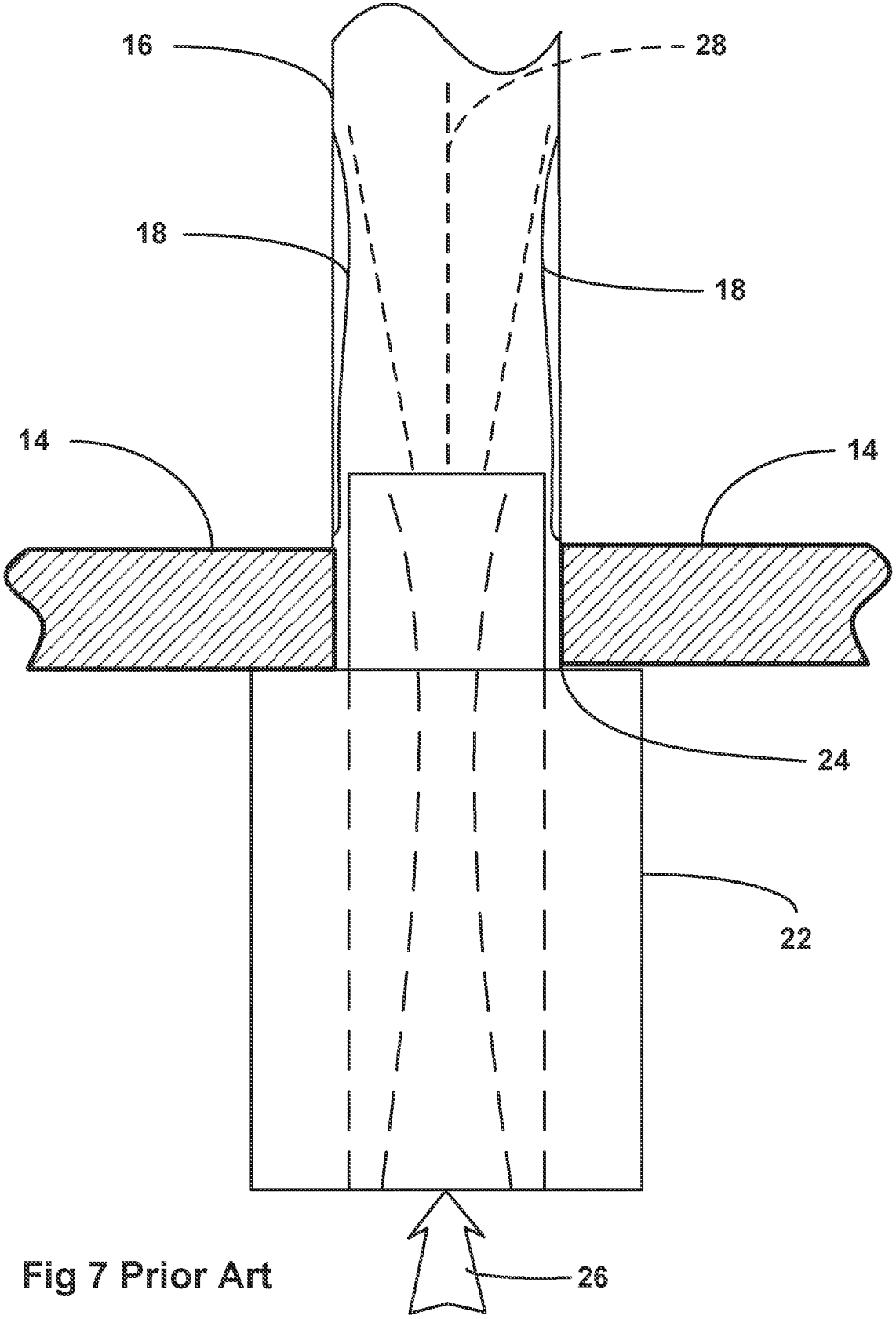
Fig 7 Prior Art
FIG. 7 is the same view as in FIG. 5 but showing how the prior art nozzle misses a substantial section of the scale present in the endmost portion of the reactor tube.

Also, as shown in FIG. 7, as the nozzle 22 is pushed inside the end of the tube 16, the cleaning effect of the grit-laden compressed air 26 does not effectively abrade the scale 18 in a substantial portion of the tube 16 adjacent the end 24 of the tube 16, because the grit-laden compressed air flow path does not spread out enough to touch the inner surface of the tube 16 until a point recessed a substantial longitudinal distance from the end 24.

Figure 8:
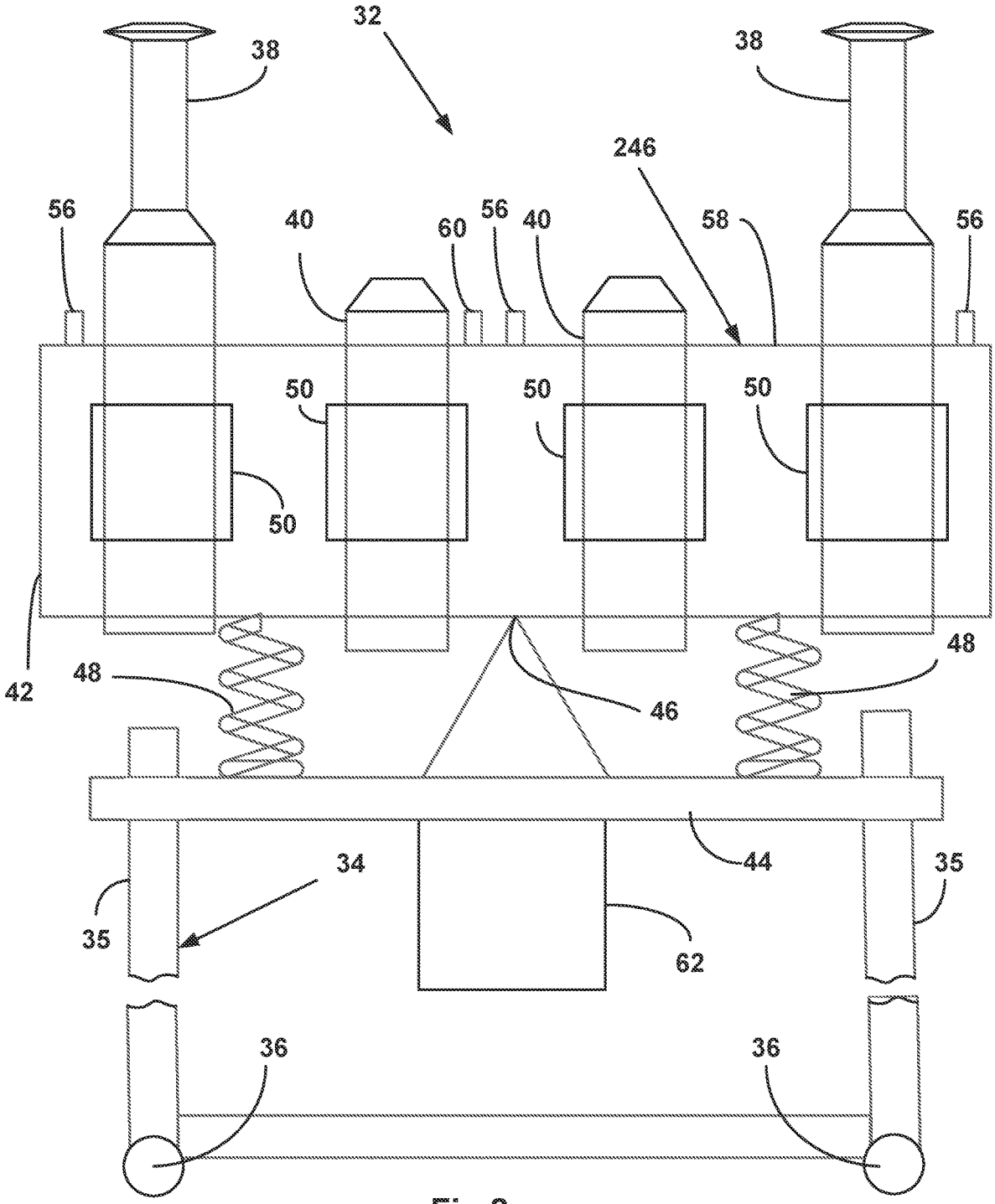
FIG. 8 is a schematic side view, partially broken away, of an arrangement for grit blasting the inner surface of at least one tube of a reactor vessel in accordance with the present invention.
Figure 10:
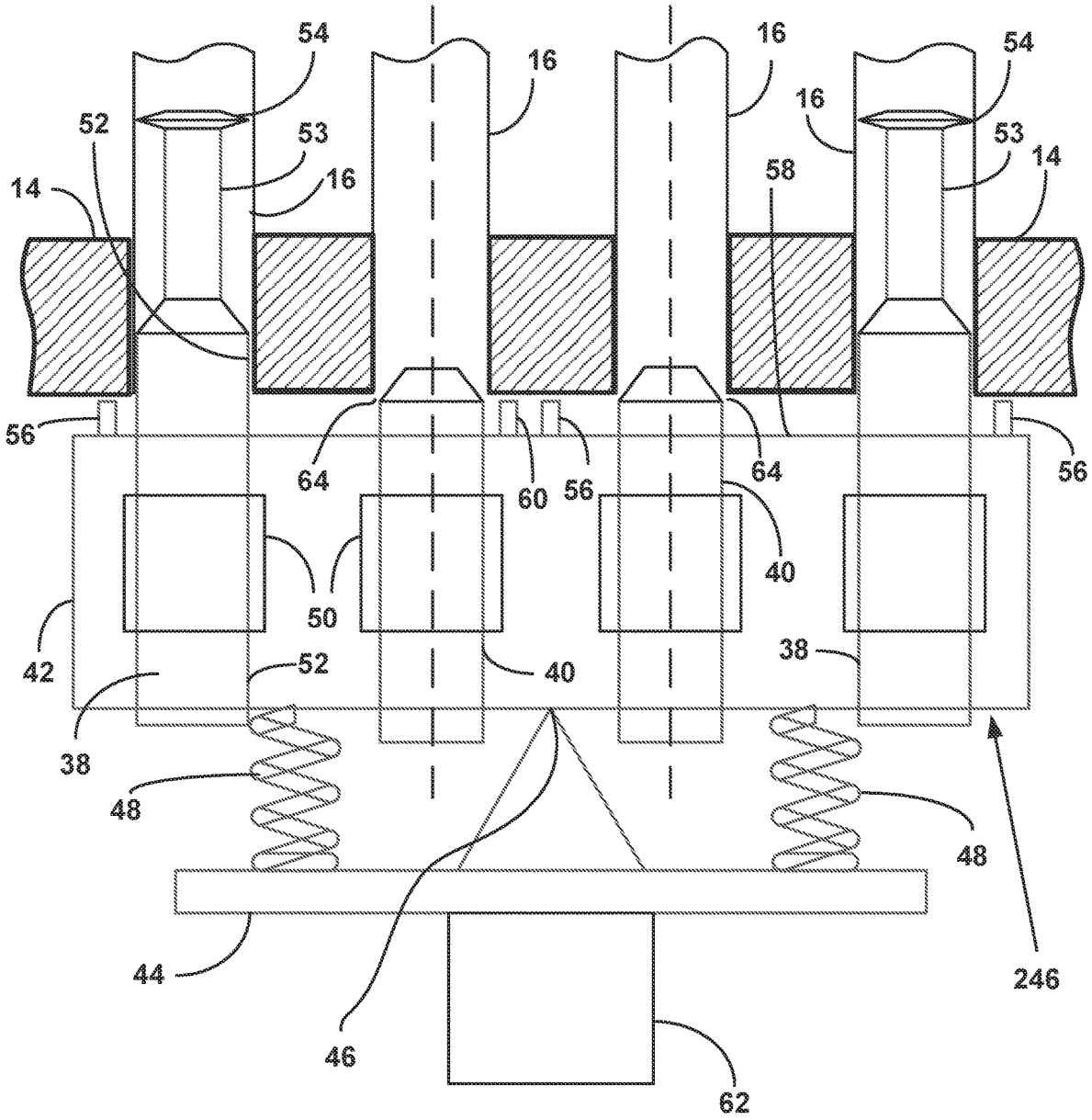
FIG. 10 is side view of the grit blasting arrangement of FIG. 8 (with the base removed for clarity) when the nozzles are almost inserted into the ends of two reactor tubes in preparation for grit blasting their inner surfaces.

Referring now to FIGS. 8 and 10, the grit blast arrangement 32 includes a wheeled base 34 which supports an elevator platform 44. The elevator platform 44 may be raised via the pneumatic air slide 62 to bring the entire head assembly 246 (which includes the positioning frame 42 and all the components mounted on the frame 42, such as the alignment pins 38, the nozzles 40, the elevator stop pins 56, and the proximity sensor 60) up against the lower tubesheet 14 in order to grit blast one or more tubes 16.

Referring to FIG. 8, the bottom portion, which is broken-away, is a base 34 with wheels 36, which serves as a base to support the grit blaster 32 and which can be moved along the bottom dome 15 of the reactor vessel 10 (See FIG. 1), or along a platform (not shown) resting on the bottom dome. While this base 34 is shown schematically with wheels 36, it may be moved around along the bottom dome 15 (or bottom platform) using other known means, such as rollers, slides, air-motor-powered wheels, electric-powered wheels or even just stationary legs which are picked up or slid by the operator to relocate the grit blasting arrangement 32, as desired. Once the operator has placed the base 34 below the tube(s) 16 to be cleaned, the operator telescopically extends the legs 35 of the base 34 to bring the grit blaster 32 close to the tubesheet 14, and then the operator operates the hydraulic slide 62 to bring the grit blaster 32 up the rest of the way to bring it into position for grit blasting. The telescopic extension of the legs 35 of the base 34 may be accomplished by a number of devices, such as by using mechanical jacks, hydraulic jacks, linear motors, or pneumatic jacks. These extension devices preferably are tied together so that all the legs 35 are extended and retracted together to prevent the accidental tipping over of the grit blasting arrangement 32 during the extension or retraction process. The legs 35 may be arranged to extend above the positioning frame 42 so they can be raised to contact the bottom surface of the tubesheet 14 to ensure that the base 34 cannot tip over.

The portion of the grit blasting arrangement 32 resting atop the base 34 includes two alignment pins 38 and one or more nozzles 40 (in this embodiment two nozzles 40 are shown), all of which are adjustably mounted on a positioning frame 42. The positioning frame 42 is biased by springs 48 against a pneumatically operated elevator platform 44, which is raised and lowered by extending and retracting the hydraulic slide 62. A universal joint 46 allows the positioning frame 42 to pivot as needed relative to the elevator platform 44 so that the plane of the positioning frame 42 will be parallel to the plane of the bottom tubesheet 14 even if the elevator platform 44 is not, as explained in more detail below.

Figure 9:
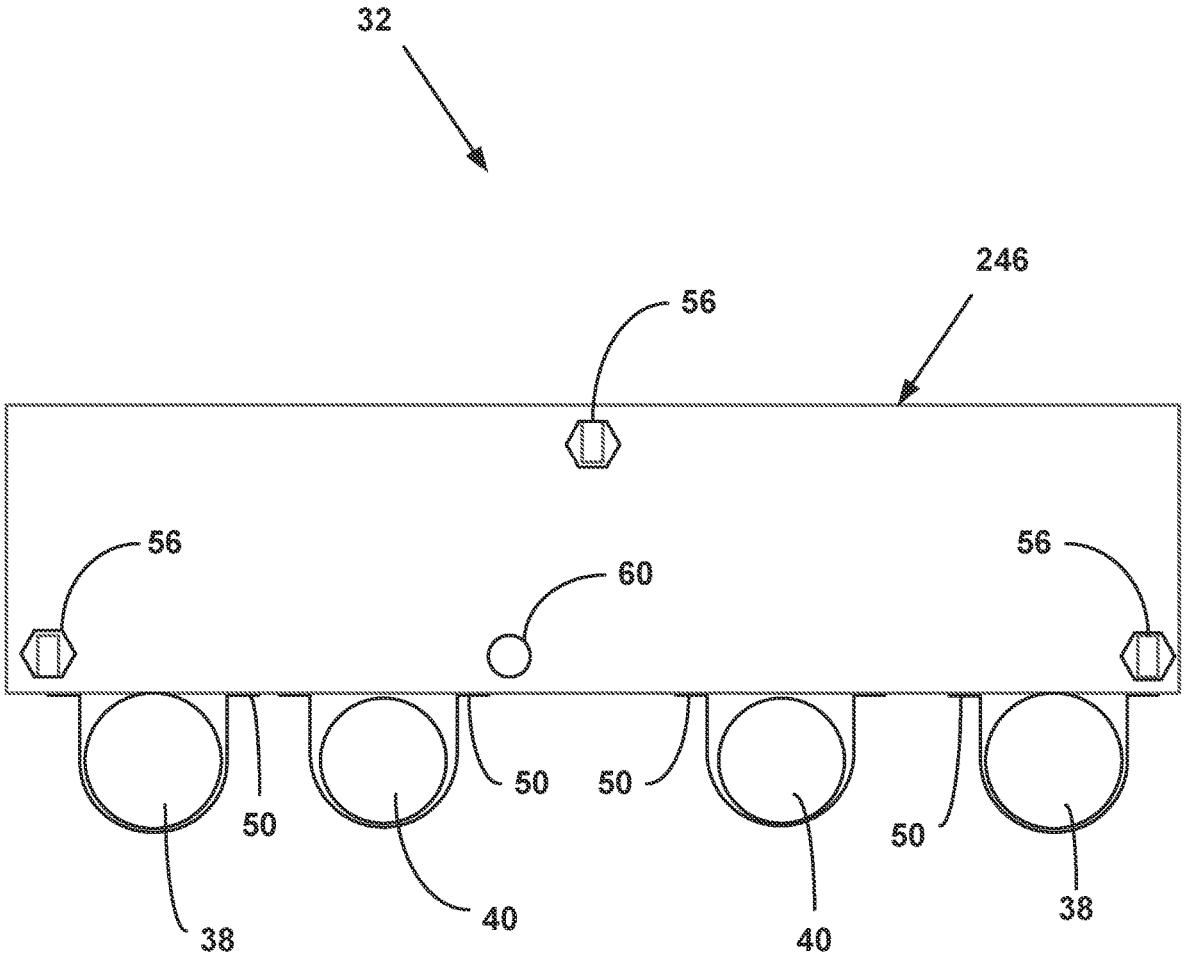
FIG. 9 is a plan view of the grit blasting arrangement of FIG. 8.

Referring to FIGS. 9 and 10, the two alignment pins 38 as well as the nozzles 40 are secured to the positioning frame 42 via bolt-on, U-shaped brackets 50, which allow the alignment pins 38 and the nozzles 40 to be adjustably positioned along the positioning frame 42. In one embodiment, the location of the alignment pins 38 and the nozzles 40 is preset using a jig (not shown) so as to match the spacing (pitch) of the tubes 16 such that, when the grit blasting arrangement 32 is located under the lower tubesheet 14 and the positioning frame 42 is raised up against the lower tubesheet 14, the alignment pins 38 will be in correct coaxial alignment with and can go into the tubes 16 (See FIG. 10), and the nozzles 40 also will be in correct coaxial alignment with their respective tubes 16. Of course, the elevator platform 44 and positioning frame 42 will only be raised after the base 34 is properly positioned.

The alignment pins 38 are sized to have a relatively tight fit inside their respective tubes 16 (See FIG. 10). The alignment pins 38 define an extended length to extend inside each tube 16 a sufficient distance to greatly reduce the possibility of any misalignment between the longitudinal axes of the nozzles 40 and the respective longitudinal axes of the tubes 16. This ensures that the grit is blasted by the nozzles 40 straight into the reactor tubes in the axial direction of the tubes 16, not at a misaligned angle as shown in FIG. 6 of the prior art. To minimize friction between the alignment pins 38 and their respective tubes 16, an intermediate portion of each alignment pin 38 is necked down to reduce the surface area contact between the alignment pin 38 and its respective tube 16. Each alignment pin 38 has a proximal portion 52 with an outer diameter just slightly smaller than the inner diameter of the tube 16. The alignment pin 38 also has a distal portion 54 with an outer diameter just slightly smaller than the inner diameter of the tube 16. Between the proximal portion 52 and the distal portion 54, the pin necks down to an intermediate portion 53 having a smaller outer diameter 53. When the alignment pin 38 is fully inserted into its respective tube 16, the larger diameter distal portion 54, the necked-down portion 53, and part of the larger diameter proximal portion 52 are all inserted into the respective tube 16. The necked-down portion 53 does not contact the inner surface of the tube 16. The length of the portion of the alignment pin 38 that is inserted into the tube 16 when the alignment pin 38 is fully inserted for grit blasting preferably is at least two times the inside diameter of the tube 16, although it may be designed to be more or less than that, as determined by the designer.

The positioning frame 42 includes three elevation (or limit) stop pins 56 which are in a non-linear relation to each other (See FIG. 9). The stop pins 56 all project the same distance above the positioning frame 42 (outwardly from the positioning frame 42). Three points define a plane, so the distal ends of the stop pins 56 define an imaginary plane, which, in this case, is perpendicular to the axes of the nozzles 40. Therefore, when the distal ends of all three stop pins 56 impact against the bottom surface of the lower tubesheet 14, the top surface 58 of the positioning frame 42 will be parallel to the plane of the bottom surface of the tubesheet 14, and the axes of the nozzles 40 will be parallel to the axes of the tubes 16. Since the alignment pins 38 and the nozzles 40 are perpendicular to the top surface 58 of the positioning frame 42, and since the alignment pins 38 and nozzles 40 are spaced apart according to the pitch of the tubes 16, then the alignment pins 38 and the nozzles 40 will be coaxial with the longitudinal axes of their respective tubes 16 when the three stop pins 56 impact against the bottom surface of the lower tubesheet 14 and the alignment pins 38 are fully inserted into their respective tubes 16.

The alignment pins 38 ensure that the positioning frame 42 is in the correct X and Y alignment position relative to the tubesheet 14. The three elevation stop pins 56 ensure that the plane of the positioning frame 42 is parallel to the bottom surface of the tubesheet 14 and determine the elevation (or Z axis) of the positioning frame 42 relative to the bottom tubesheet 14. Since this arrangement ensures that the nozzle(s) 40 are coaxial with the respective tubes 16, it is not necessary for the nozzle(s) to enter their respective tubes 16 as in the prior art. Instead, a small gap 64 (See FIG. 10) may be provided between the nozzles 40 and the bottom end of the tube 16. (It should be noted that the grit blasting could be done from the top of the tubes, in which case the gap 64 would be between the nozzle(s) 40 and the top end of the tube(s) 16.

The insertion of the nozzle 40 into or toward the respective end of the tube 16 to a position that leaves a gap 64 allowing air to pass through between the body of the nozzle 40 and the end of the tube 16 (instead of abutting the tube16 and preventing air flow between the body of the nozzle 40 and the end of the tube 16), is preferred for a number of reasons. First, the grit-laden air stream creates a strong venturi effect which drags even more air into the end of the tube 16 through the gap 64 to mix and blend with the compressed air and grit already flowing out of the end of the nozzle 40. This provides an even stronger total air flow to propel the grit particles and thus provides better cleaning. Second, it enables the entire length of the tube 16 to be cleaned, since no portion of the inner surface of the tube 16 is obstructed by the nozzle 40, especially at the inlet end, thus eliminating the need for a secondary step to grit blast clean the first few inches of tube length. The alignment pins 38 are of sufficient length that they properly locate the positioning frame 42 to be aligned in both horizontal directions (along both the X and Y horizontal axes) with the nozzles 40 axially aligned with their respective tubes 16, and the three limit pins 56 are also of sufficient length that they ensure alignment of the positioning frame 40 parallel to the plane of the tube sheet 14 while maintaining a gap 64 between the nozzles 40 and their respective tubes 16.

The positioning frame 42 also includes a sensor, or limit switch 60, which will not complete a circuit unless and until the sensor 60 is in contact with the tubesheet 14, indicating that it is safe to initiate the flow of grit-laden compressed air through the nozzles 40. The limit switch 60 preferably is a switch style that is on a four to twenty milliamp control circuit instead of a simple voltage switch. This allows for improved control to ensure that the grit-laden air flow will not occur in the case of a short circuit in the control wiring.

Figure 12:
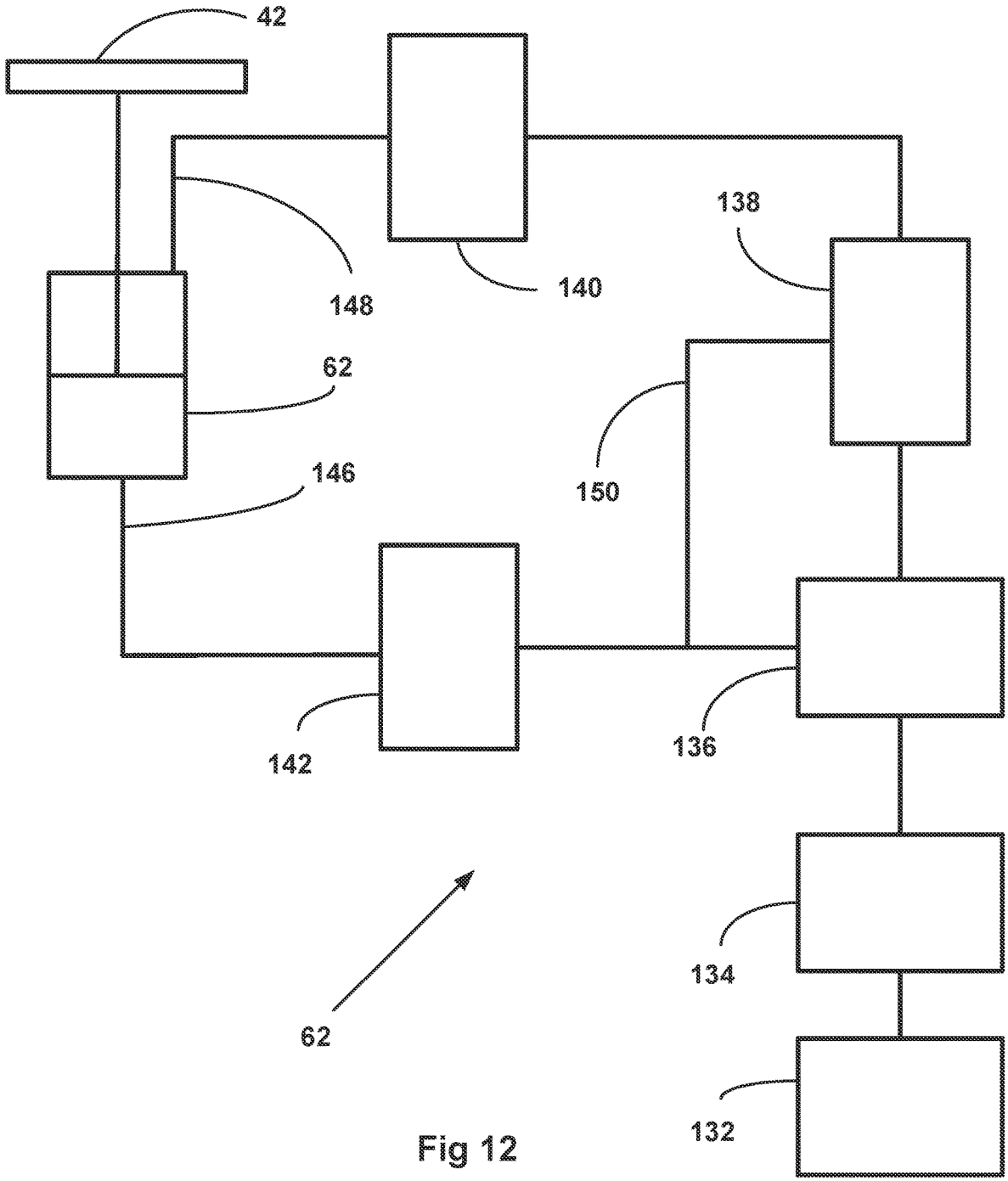
FIG. 12 is an air logic schematic for the air slide valve mechanism for the grit blasting arrangement of FIG. 8.

The pneumatic air slide 62 is shown schematically in FIG. 8. As shown in FIG. 12, the mechanism for operating the pneumatic air slide 62 includes a pressurized air supply 132, a pressure regulator 134, a directional control valve 136, a pilot operated check valve 138, a piston-retraction adjustable flow control valve 140, a piston-extension adjustable flow control valve 142, and a slide 62, which includes a piston inside a tubular chamber having a first side and a second side. A first air supply line 146 is in communication with the first side for extending the air slide 62 so as to push against and raise the positioning frame 42 (See FIG. 8) up toward the bottom surface of the lower tubesheet 14. A second air supply line 148 is in communication with the second side for retracting the slide 62 so as to lower the positioning frame 42.

The pneumatic air slide mechanism 62 is designed to push the pins 56 of the positioning frame 42 up against the bottom surface of the lower tubesheet 14 with a preset force (as an example 60 PSI) and hold the frame 42 there with that force (which is enough to lift the positioning frame 42 and counter the reactive force of the grit blast air stream). However, if the reactive force (that is, the force pushing back against the slide valve 62) becomes much higher, (as an example 90 PSI), indicating a possible blockage in the tube(s) being cleaned, the pressure in the air supply line in 146 will increase, which also increases the pressure in the feedback line 150. In this case, the increased pressure to the pilot operated check valve 138 immediately signals the directional control valve 136 to relieve the pressure of the air going to the first air supply line 146 and redirects the pressurized air to the second air supply line 148 to retract the air slide 62 and thus to lower the positioning frame 42 before the pressure in the tube 16 becomes too high.

Further, and as explained earlier, it should be noted that an intentional gap 64 is kept (See FIG. 10) between the distal end of the nozzle 40 and the inlet end of the reactor tube 16 so that excessive pressure does not build up inside the tube 16 even if there is a blockage in the tube 16.

To operate the grit blasting arrangement 32, the operator moves the base 34 until the nozzle(s) are approximately aligned directly beneath the tubes 16 to be grit blasted. He then extends the telescoping legs 35 of the base 34 to raise the platform 44 and positioning frame 42 close to the tubesheet 14. He then operates the directional control valve 136 to direct air through the first air supply line 146, which starts extending the air slide 62 to raise the positioning frame 42. As the positioning frame 42 is approaching the tubesheet 14, the operator watches carefully and jostles the base 34 as needed to ensure that the alignment pins 38 are going into the correct tubes 16 being used for alignment. As indicated earlier, an alignment jig (not shown) may be used prior to beginning the job in the field in order to properly align the device 32 to the correct tube pitch. The alignment jig and/or a calibration arrangement (described later with respect to FIG. 35) also can be used to calibrate each grit pot to ensure it is dispensing the correct amount of grit over extended periods of use.

The alignment pins 38 begin entering their respective tubes 16, and the operator 20 continues to raise the positioning frame 42 until the limit pins 56 are pressed against the bottom tubesheet 14. At this point, the positioning frame 42 and the bottom tubesheet 14 are parallel, and the longitudinal axes of the nozzles 40 are coaxial with the longitudinal axes of their respective tubes 16. Also at this point, the limit switch 60 is in contact with the tubesheet 14, completing the circuit and thereby sensing and communicating with the controller that the grit blaster 32 is in proper position to begin operation.

Figure 42:
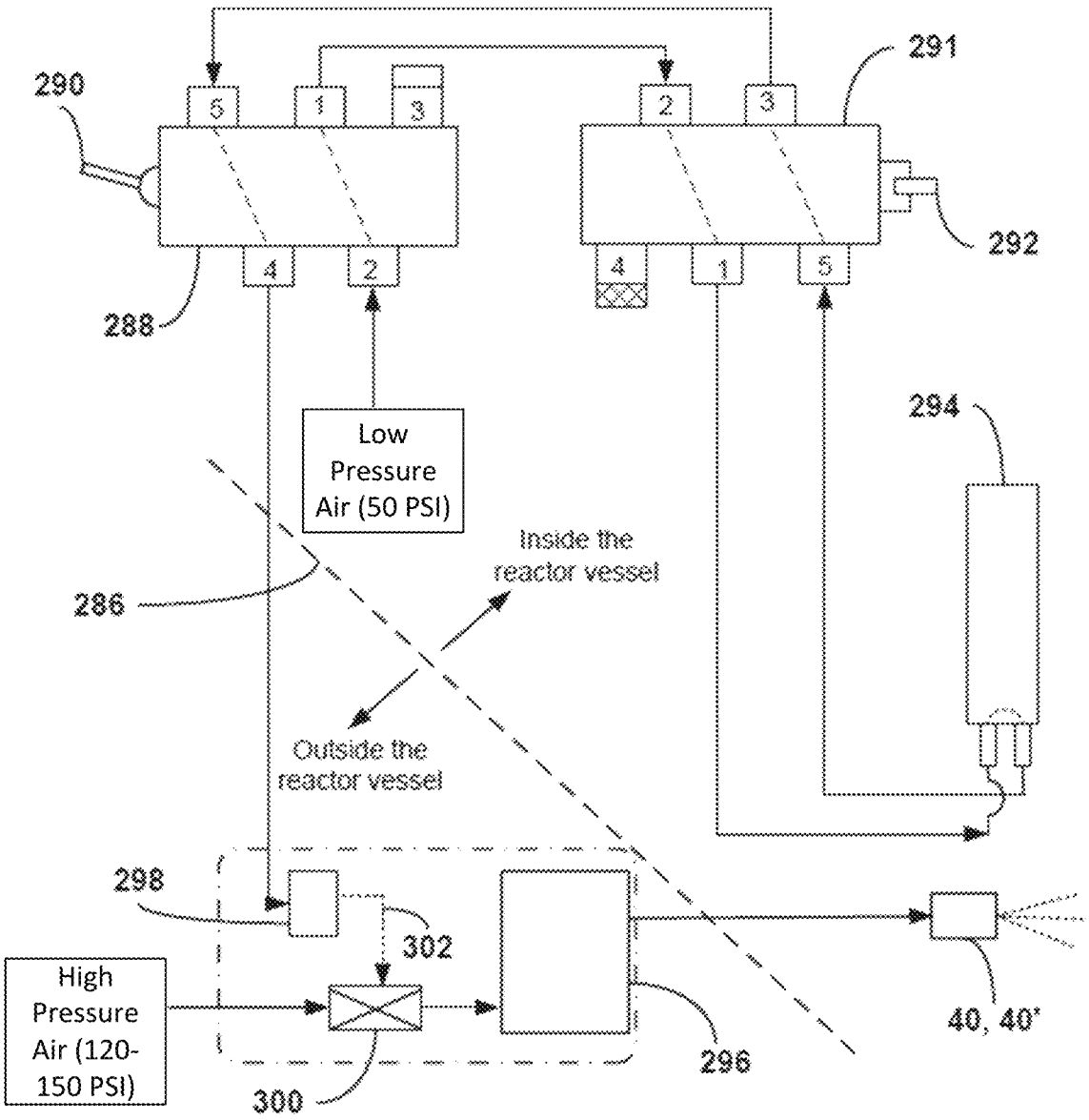
FIG. 42 is a schematic of the control to initiate grit blasting of a tube(s) in the reactor.

With the directional control valve 136 still supplying pressurized air through the first line 146 to keep the positioning frame 42 in the upper, contact position, the operator 20 stands back and presses a deadman switch (not shown) which allows the pressurized air/grit mixture to flow through one or more of the nozzles 40 for a pre-programmed period of time to grit blast the tube(s) 16. When the period of time is ended, the controller stops the flow of pressurized air/grit to complete the cycle. (The control arrangement for the deadman switch and flow of grit-laden air is shown in FIG. 42.) Upon completion of the cycle, the operator releases the deadman switch to reset the timer, retracts the legs 35, and moves the base 34 and the grit blaster 32 to the next set of reactor tubes 16 to be grit blasted. While the grit blaster 32 is being repositioned, the grit pot (not shown) may be depressurized, refilled, and re-pressurized for the next cycle.

Figure 11:
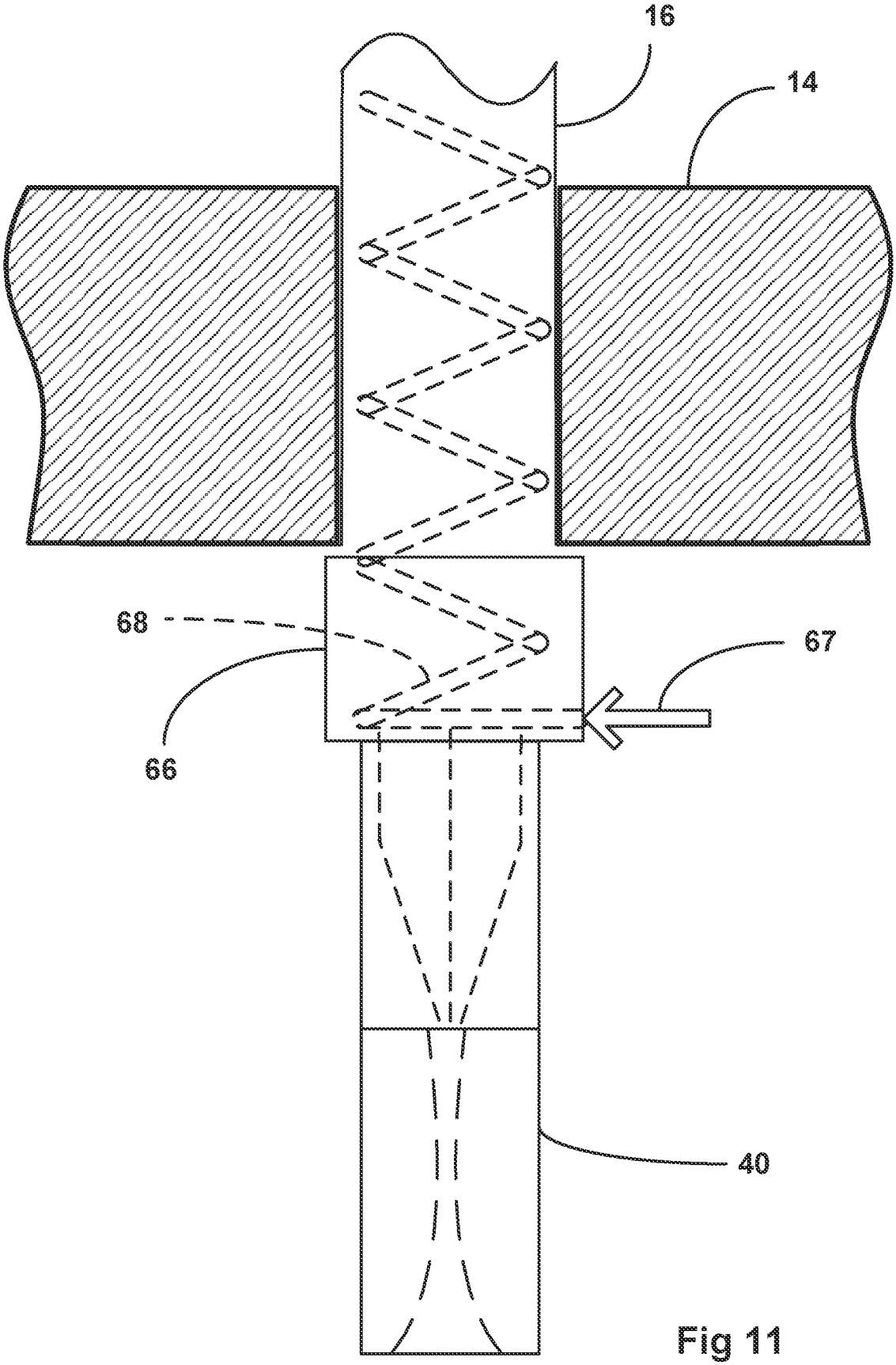
FIG. 11 is a schematic side view of an alternative grit blasting nozzle with a flow enhancer, which could replace the nozzle of FIGS. 8-10, showing schematically how the flow enhancer improves the scouring characteristics, especially at the endmost portion of the reactor tube.

Referring now to FIG. 11, it can be seen that the nozzle 40 may include a flow enhancer 66 designed to set a swirling, scouring motion to the grit-laden compressed air 68 by tangentially injecting a stream 67 of pressurized air in addition to the grit-laden air flowing through the nozzle 40. This enhanced air flow together with the gap 64 described earlier with respect to FIG. 10, ensures that the grit blaster 32 removes the scale 18 (See FIG. 3) all the way down to the bottom of the tube 16.

A laser tracking system similar to the laser tracking system disclosed in the Johns, et al. U.S. Pat. No. 7,913,543, "Method of using a device for measuring the back pressure in chemical reactor tubes", dated Mar. 28, 2011, which is hereby incorporated herein by reference, may be used in the grit blaster 32. It would include a laser mounted on the base 34 or positioning frame 42. This tracking system provides real time feedback on the tube(s) currently being grit blasted, how many tubes have been grit blasted, how many tubes still have to be grit blasted, percentage of tubes cleaned, and even an estimated time of completion of the grit blasting of all the tubes based on the performance thus far.

Figure 13:
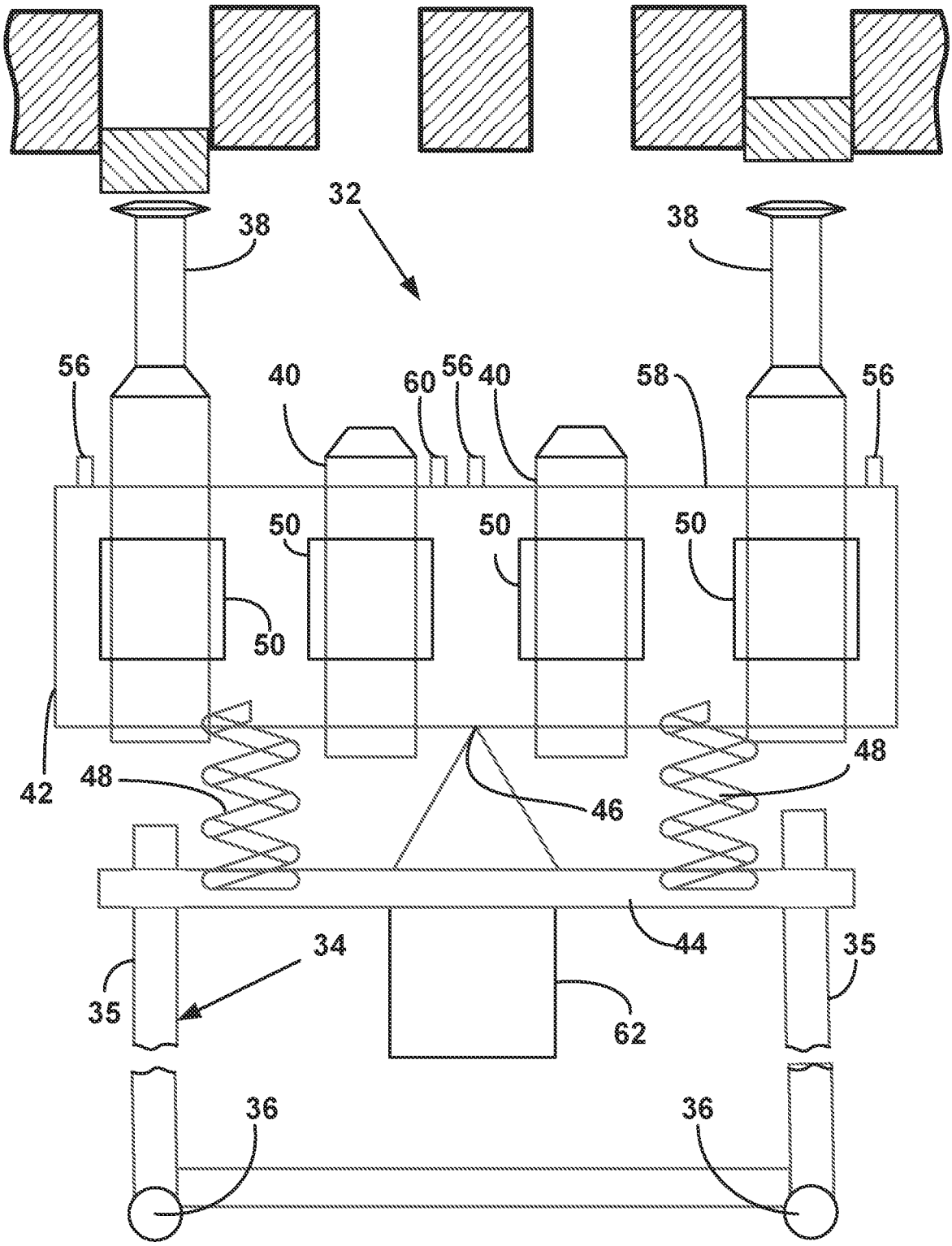
FIG. 13 is a side view similar to FIG. 10 but showing the bottom end of two tubes which are plugged and thus rendering the use of the grit blasting arrangement of FIG. 10 useless in this instance.
Figure 14:
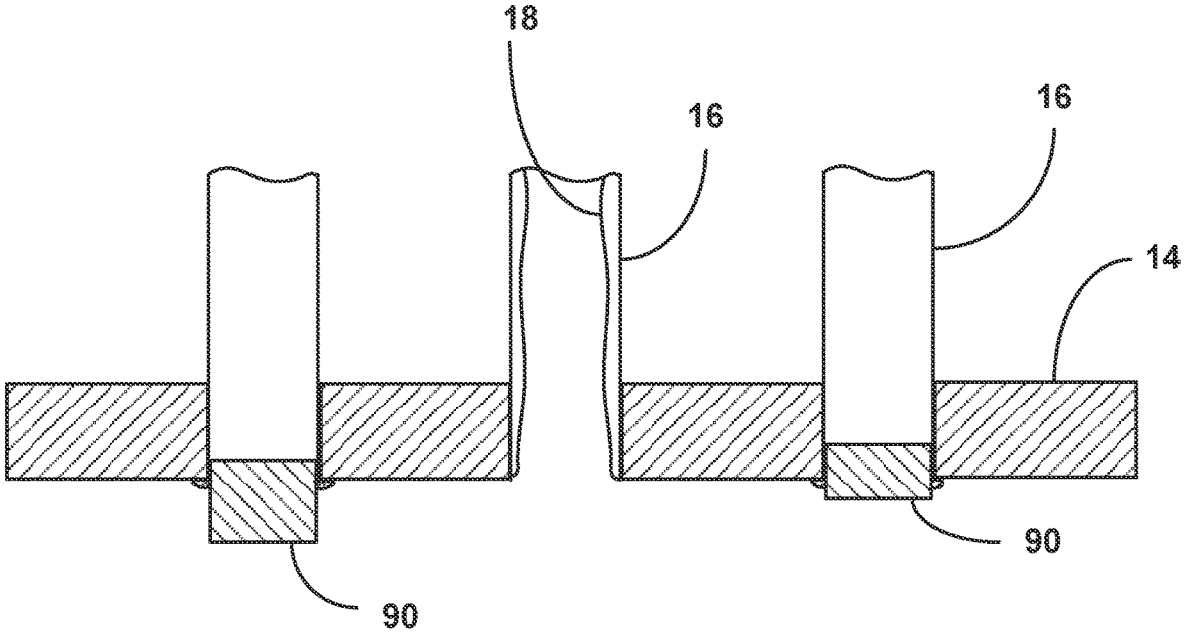
FIG. 14 is a broken-away, section view of the lower tubesheet with two of the tubes adjacent the tube to be grit blasted having been permanently plugged.

Sometimes, the device 32 cannot be used, because the tube(s) to be grit blasted is not surrounded by empty tubes to receive the alignment pins 38 of the grit blasting arrangement 32 of FIG. 8, as shown in FIG. 13 which depicts a situation wherein the alignment pins 38 would impact the plugs on the reactor tubes. A similar situation is depicted in FIG. 14 which shows a single tube 16 to be grit blasted which is surrounded by two tubes which have been permanently sealed shut with plugs 90 welded to the bottom of the tubes. As may also be appreciated, the plugs 90 are not the same size and do not project the same distance downwardly from the lower tubesheet 14. In this instance, it is not practical to use the grit blasting arrangement 32 of FIG. 8 to remove the scale 18 from the tube 16.

FIGS. 15-27 show another embodiment of a grit blasting arrangement 92 which may be used to clean out reactor tubes which are not conveniently surrounded by empty tubes to accommodate the alignment pins 38 of the first grit blasting arrangement 32 of FIG. 8. It may be noted that this grit blasting arrangement 92 includes a base 34 which is the same as the base 34 of the first grit blasting arrangement 32.

Figure 15:
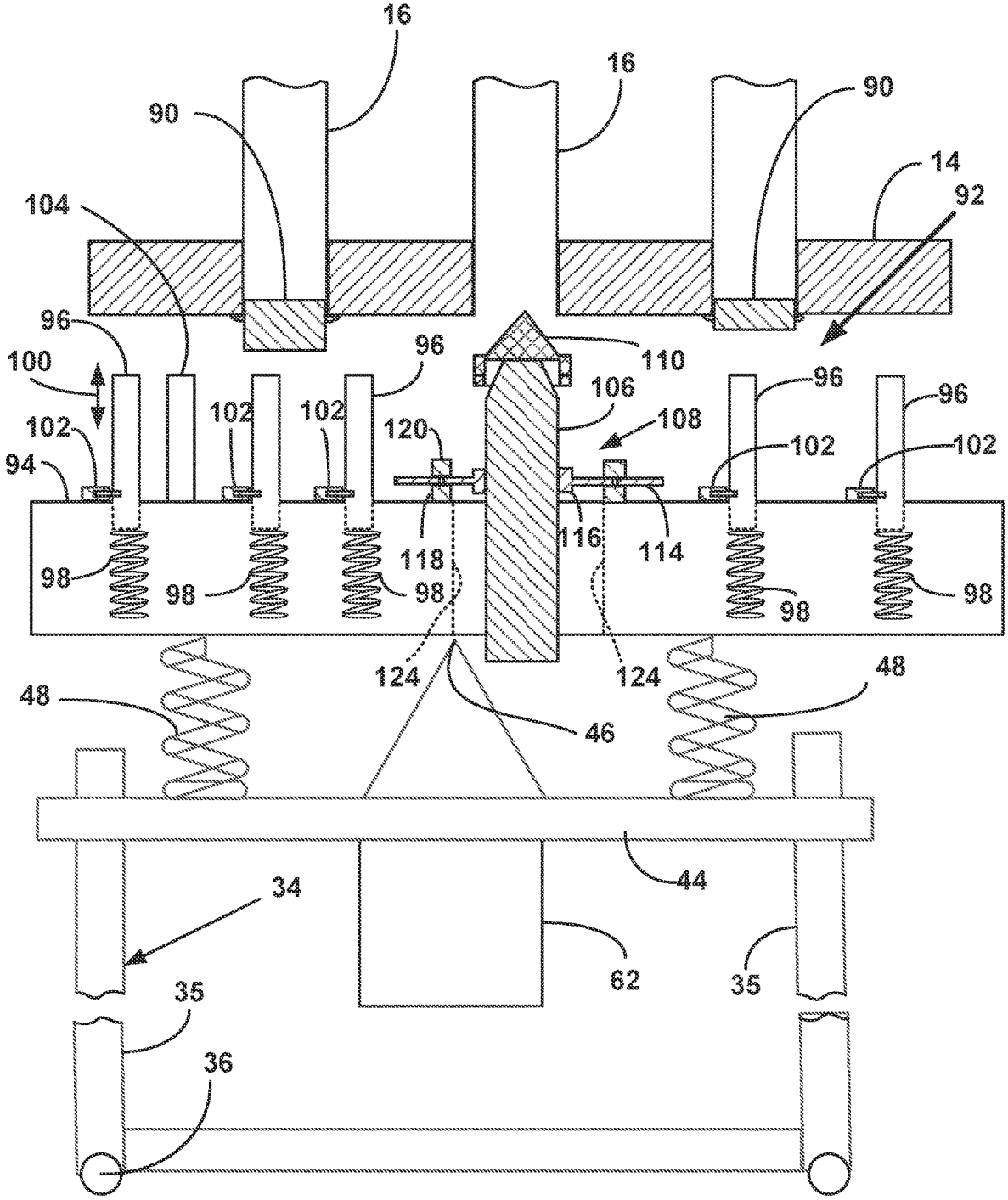
FIG. 15 is a schematic side view, partially broken away, of an alternative arrangement for grit blasting one tube of a reactor vessel.

Referring to FIG. 15, it can be seen that there are some differences between this embodiment and the previous embodiment. First, there are more stop pins 96 to ensure that the positioning frame 94 is parallel to the plane of the bottom surface of the tubesheet 14, and these stop pins 96 can be retracted into the positioning frame 94 if they meet with an obstacle. At least three of the stop pins 96 in a non-linear arrangement are locked in place in an extended (non-retracted) position to perform the same function as the stop pins 56 of the previous embodiment while other stop pins 96 may be retracted to avoid contacting projections from the surface of the tube sheet 14. Second, this arrangement allows for some horizontal shifting between the nozzle 106 and the positioning frame 94 to axially align the nozzle 106 with the tube 16 even if the positioning frame 94 itself is not exactly aligned. Once the nozzle 106 is properly aligned, it is locked in place. This arrangement does not use positioning pins that extend into adjacent tubes 16 as in the previous embodiment.

Looking in more detail at FIG. 15, it can be seen that each elevation stop pin 96 is located in a cylindrical bore in the positioning frame 94 and is biased by a spring 98 to allow the stop pin 96 to be pushed vertically downwardly relative to the positioning frame 94 against the spring from an extended position to a retracted position, and then allows the spring 98 to push the stop pin 96 back out from the retracted position to the extended position, as depicted by the arrow 100. Each elevation stop pin 96 also includes a locking mechanism 102 to lock the respective elevation stop pin 96 in the extended position. The locking mechanism 102 includes a finger that is received in a slot in the stop pin 96 to lock the stop pin 96 in position relative to the positioning frame 94.

In FIG. 15, all of the elevation stop pins 96 are shown in the locked position. However, it can be seen that the plugs 90 in two of the tubes 16 will abut two of the stop pins 96 directly below the plugs 90, creating an interference that prevents the other stop pins 96 from coming into contact with the bottom surface of the tubesheet 14. When that situation occurs, the locking mechanisms 102 are released for those stop pins 96 for which there would be interference in order to permit the remaining stop pins 96 to perform their intended function of aligning the alignment frame 94 with the tubesheet 14.

FIGS. 16-19 show the elevation stop pins 96 that would have received interference from the tube plugs 90 with their locking mechanisms 102 in the unlocked position to allow those elevation stop pins 96 to be pushed down relative to the positioning frame 94 to allow the remaining stop pins 96 to perform their intended function. FIGS. 16-19 also show a sequence of events that may be used to align the positioning frame 94 with the bottom tubesheet 14 and the nozzle 106 with the tube 16 before beginning the grit-blasting. This sequence of events will be described later.

The positioning frame 94 also includes a sensor, or limit switch 104, which performs the same function as the limit switch 60 in the previous embodiment, preventing the flow of grit/air mixture through the nozzle 106 unless the sensor 104 contacts the bottom surface of the bottom tubesheet 14.

As was mentioned earlier, the nozzle 106 in this embodiment has the ability to be shifted horizontally relative to the positioning frame 94 in order to obtain proper axial alignment with the tube 16 to be grit blasted. This is accomplished by providing a cylindrical opening 124 through the positioning frame 94 with a substantially larger diameter than the outside diameter of the nozzle 106 and by providing a mounting mechanism 108 that permits the nozzle 106 to be fixed at any desired horizontal position within that large diameter opening 124 while keeping the axis of the nozzle 106 perpendicular to the positioning plate 94. Also, a removable centering cone 110 is used to help center the nozzle 106 in the tube 16.

Figure 25:
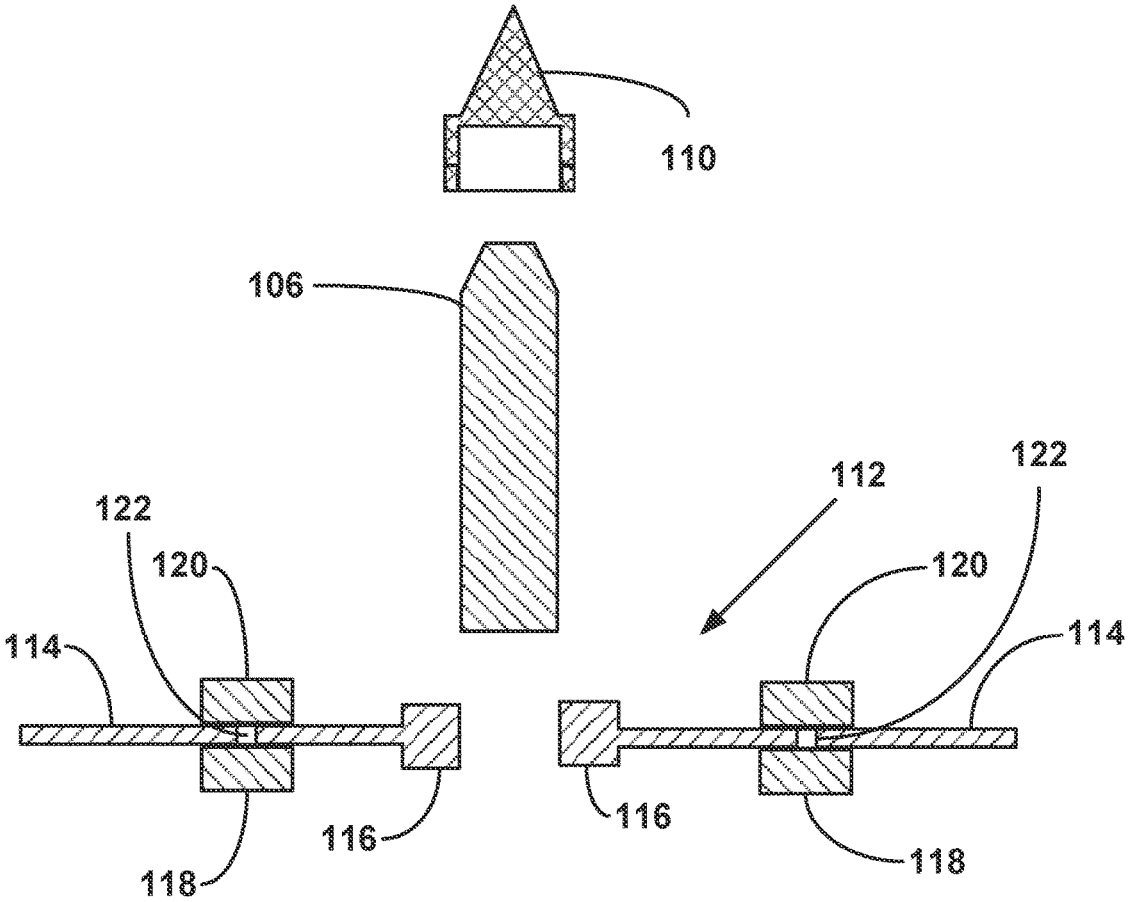
FIG. 25 is an exploded, section view of the nozzle positioning and securing mechanism of FIG. 20, also including the nozzle and its centering cone.
Figure 26:
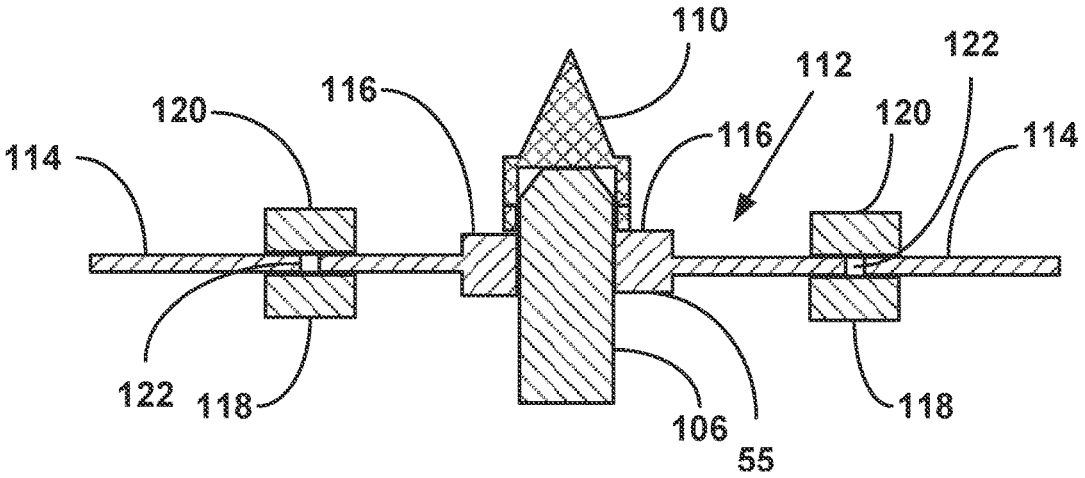
FIG. 26 is a section view of the assembled nozzle positioning and securing mechanism with the nozzle and centering cone of FIG. 25.
Figure 27:
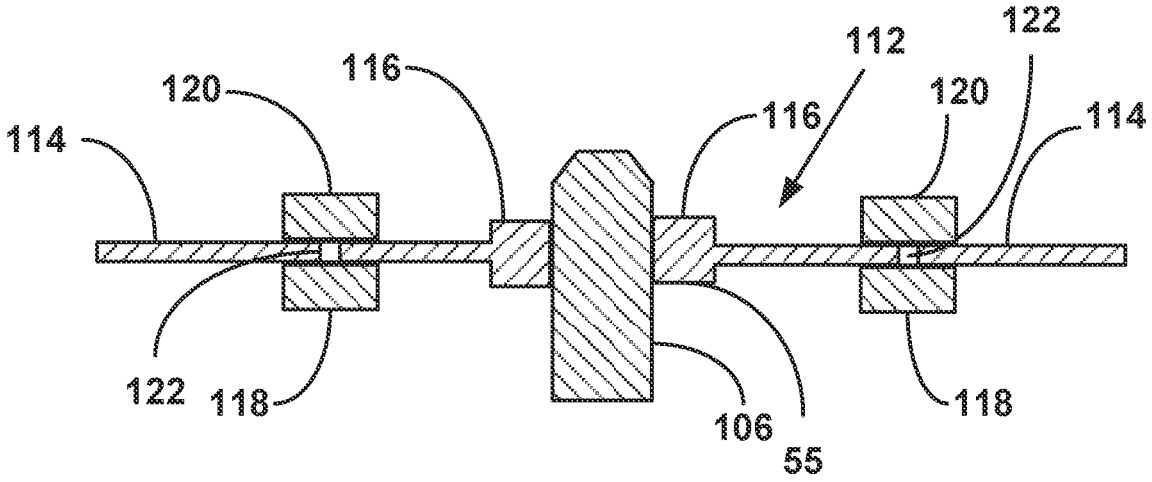
FIG. 27 is a section view, similar to that of FIG. 26, of the assembled nozzle positioning and securing mechanism with centering cone removed.

FIGS. 20-26 show the nozzle positioning and securing mechanism 108 that is used in the grit blaster 92 of FIGS. 15-19. The nozzle positioning and securing mechanism 108 includes a "floating cross" 112 having four arms 114 secured to a central ring 116. The central ring 116 has an inside diameter just slightly larger than the outside diameter of the nozzle 106, and the nozzle 106 is received in and is fixed to that central ring 116, as shown in FIGS. 26 and 27.

As shown in FIGS. 25 and 26, parallel and concentric upper and lower outer rings 120, 118 are held together by spacers 122, defining a gap slightly taller than the thickness of the arms 114 of the cross 112. The arms 114 of the cross 112 extend through that gap and rest on the lower outer ring 118. The arms 114 may slide to various horizontal positions relative to the fixed outer rings 120, 118 as shown in FIGS. 20-24.

As shown in FIG. 15, the upper and lower outer rings 120, 118 are fixed to the top of the alignment frame 94 with their inside diameters matching the inside diameter of the large cylindrical opening 124 in the alignment frame 94. The bottom surface of the lower outer ring 118 rests on the positioning frame 94.

Once the nozzle 106 is mounted in the inner ring 116, and the cross has been slid to the desired location, where the nozzle 106 is coaxial with the tube 16, the cross 112 is locked in place. The locking may be done by any one or more of a number of known means. For example, the arms 114 of the cross 112 may be made of a ferro-magnetic material and may be locked in place relative to the outer rings 118, 120 by energizing an electromagnet (not shown) which magnetizes the upper ring 120 or the lower ring 118 which then holds onto the arms 114. As long as the electromagnet remains energized, the cross 112 remains locked in place relative to the positioning frame 94. Alternatively, the cross 112 may be locked in place by a clamp or other known arrangement.

Referring to FIGS. 25 and 26, the nozzle 106 is substantially identical to the nozzles 40 of FIG. 8. A removable centering cone 110 rests snugly atop the nozzle 106 and is used to axially align the nozzle 106 with the vertical axis of the reactor tube 16 to be grit blasted, as discussed later. The nozzle 106 itself is firmly secured, as by welding, gluing, or clamping, for instance, to the inner ring 116 of the cross 112.

To operate the grit blasting arrangement 92, the operator 20 moves the base 34 and the grit blasting device 92 approximately under the tube 16 to be grit blasted, as shown in FIG. 15. Then the operator 20 raises the telescoping legs 35 of the base 34 until they abut the tubesheet 14 to lock the base 34 against movement relative to the lower tubesheet 14.

The operator then operates the directional control valve 136 (See FIG. 12) to begin admitting air to the first side of the air slide 62 to raise the positioning frame 94 toward the tubesheet 14, moving the nozzle positioning mechanism 108 to align the centering cone 110 with the tube 16.

Figure 16:
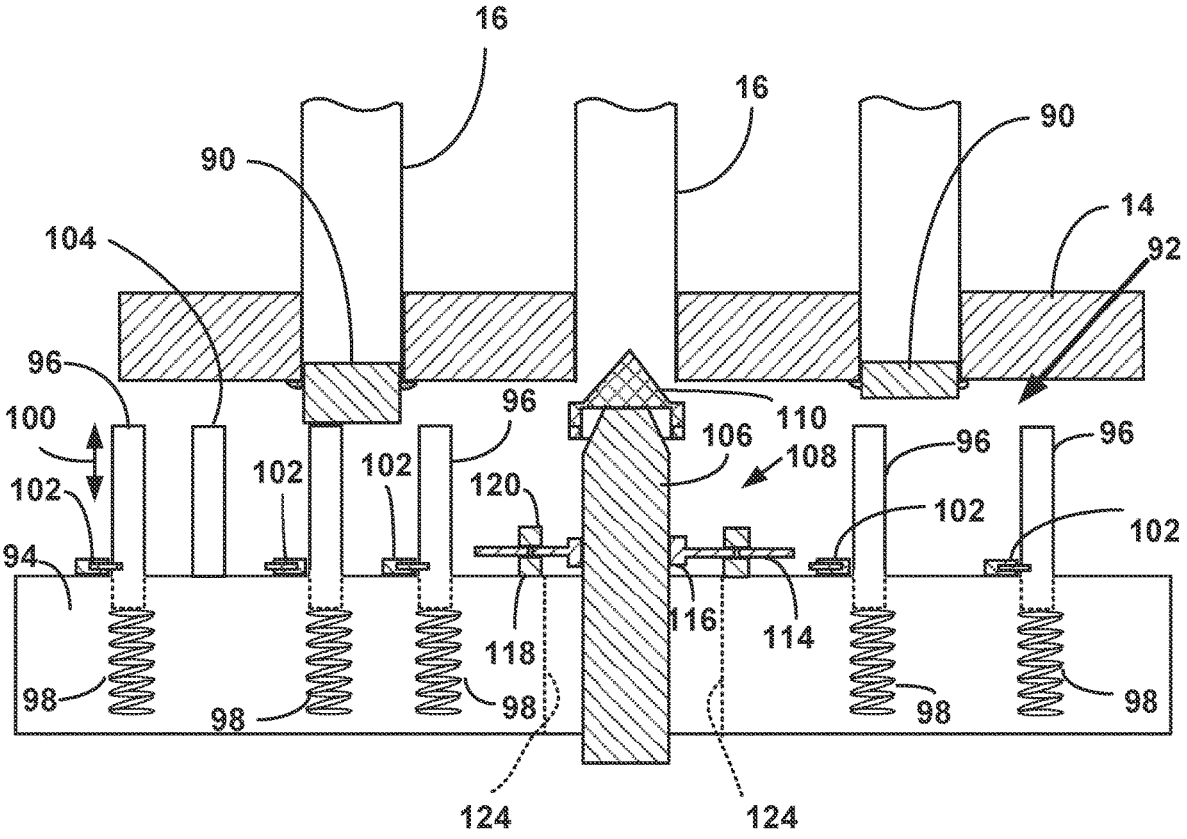
FIG. 16 is a view similar to that of FIG. 15 (with the base removed for clarity), showing the positioning frame raised to a first level where contact is first established with the lower tubesheet, namely when one of the limit pins first contacts a plug on a reactor tube.
Figure 17:
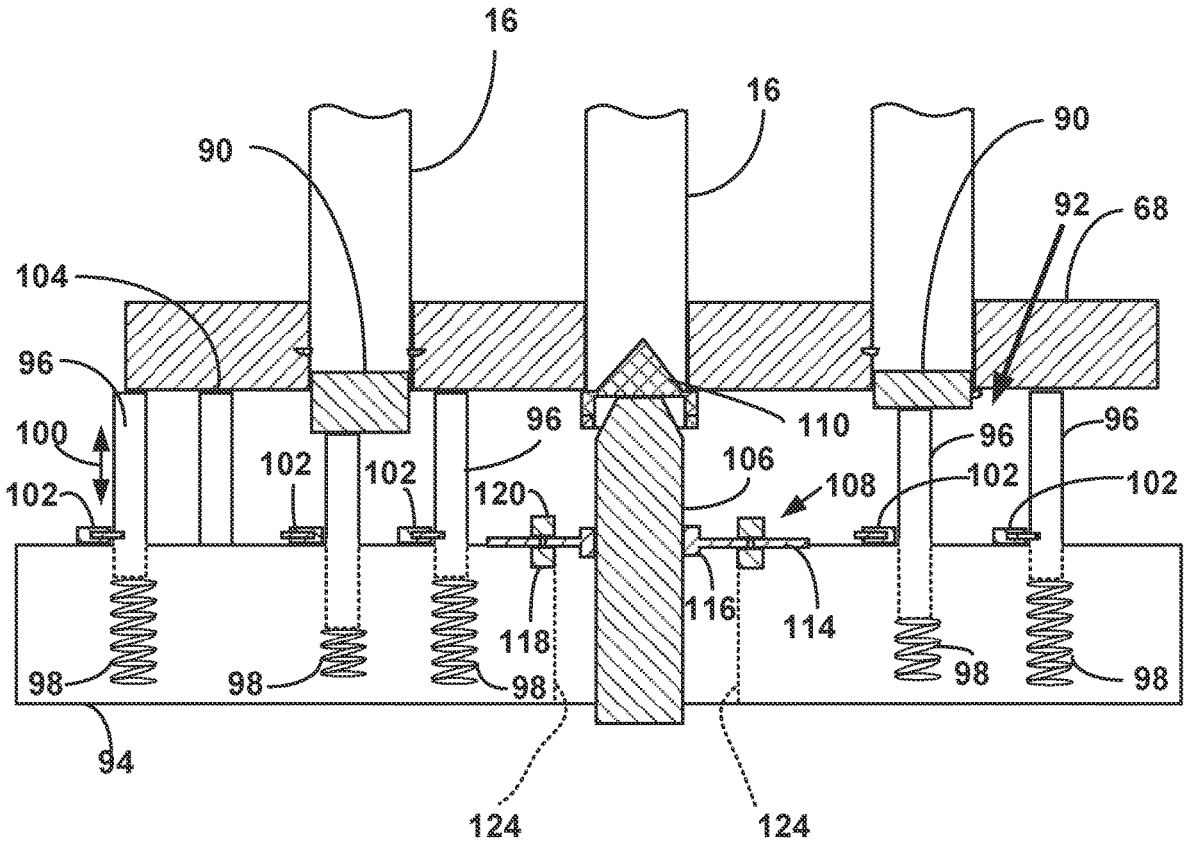
FIG. 17 is a view similar to that of FIG. 16, showing the positioning frame raised to a final level where the frame is parallel to the plane of the lower tubesheet.

The operator 20 continues to raise the positioning frame 94 until the elevation limit pins 96 are almost in contact with any obstructions in the bottom surface of the lower tubesheet 14, such as the plugs 90, as shown in FIG. 16. The user 20 then unlocks the lock mechanisms 102 of those elevation stop pins 96 that are approaching the obstructions 90 so that when those unlocked elevation stop pins 96 encounter an obstruction, they will be pushed down against their respective springs 98 to a retracted position as the positioning frame 94 continues to be raised, as shown in FIG. 17.

The conical top surface of the centering cone 110 aids the user 20 in aligning the axis of the nozzle 106 with the axis of the tube 16 to be cleaned. When the still-locked elevation stop pins 96 are fully pressed against the bottom tubesheet 14, the positioning frame 94 and the bottom tubesheet 14 are parallel, and thus the longitudinal axis of the nozzle 106 is perpendicular to the plane of the bottom surface of the lower tubesheet 14 and parallel to the longitudinal axes of the tubes 16.

Figure 18:
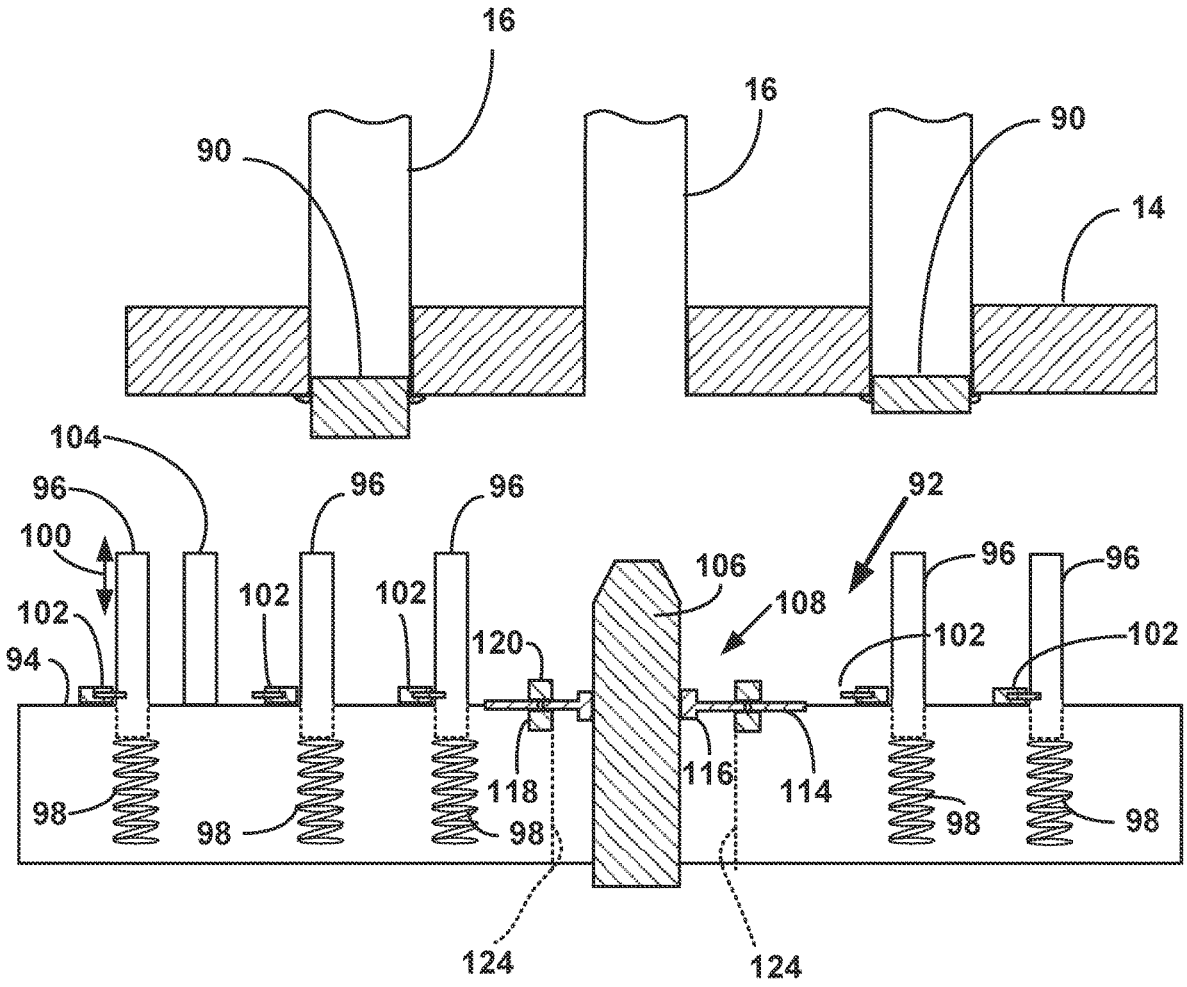
FIG. 18 is a view similar to that of FIG. 17, showing the positioning frame lowered to the same level as in FIG. 15 and having the centering cone removed from the nozzle in preparation for grit blasting.
Figure 19:
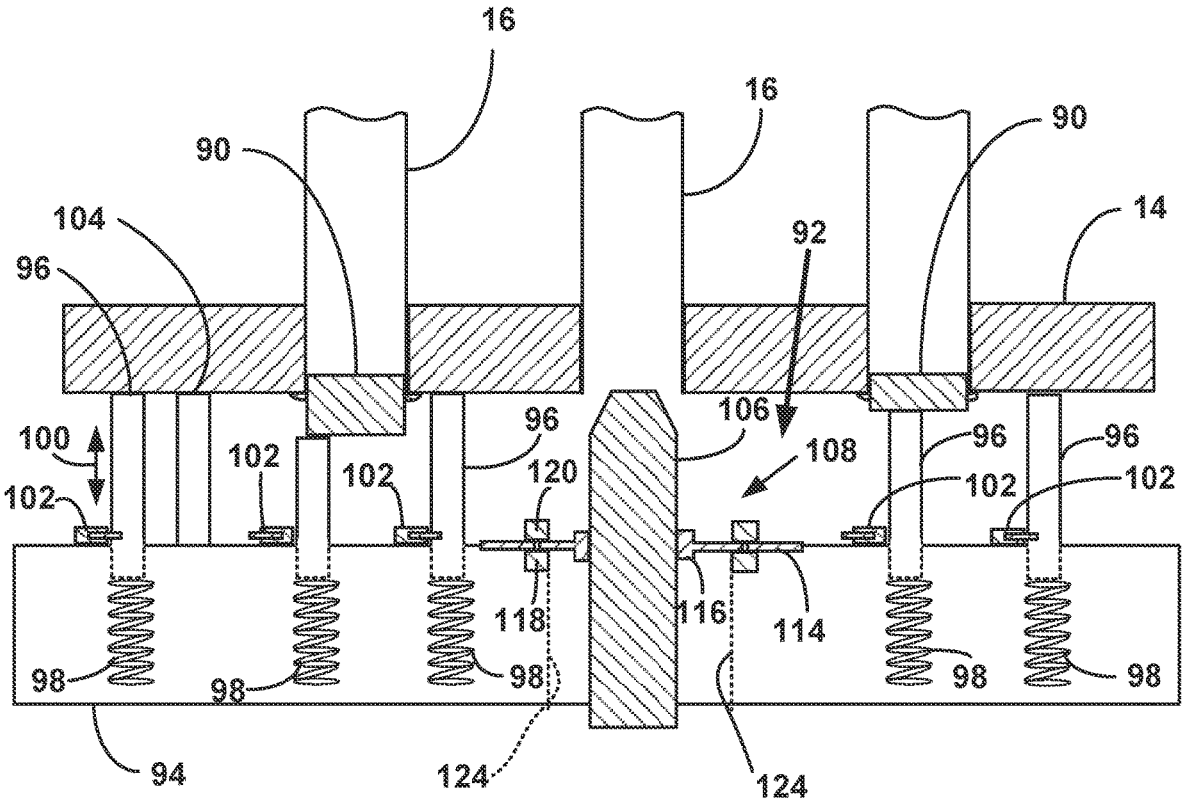
FIG. 19 is a view similar to that of FIG. 18, showing the positioning frame raised to the same level as in FIG. 17 and having the centering cone removed from the nozzle in preparation for grit blasting.
Figure 20:
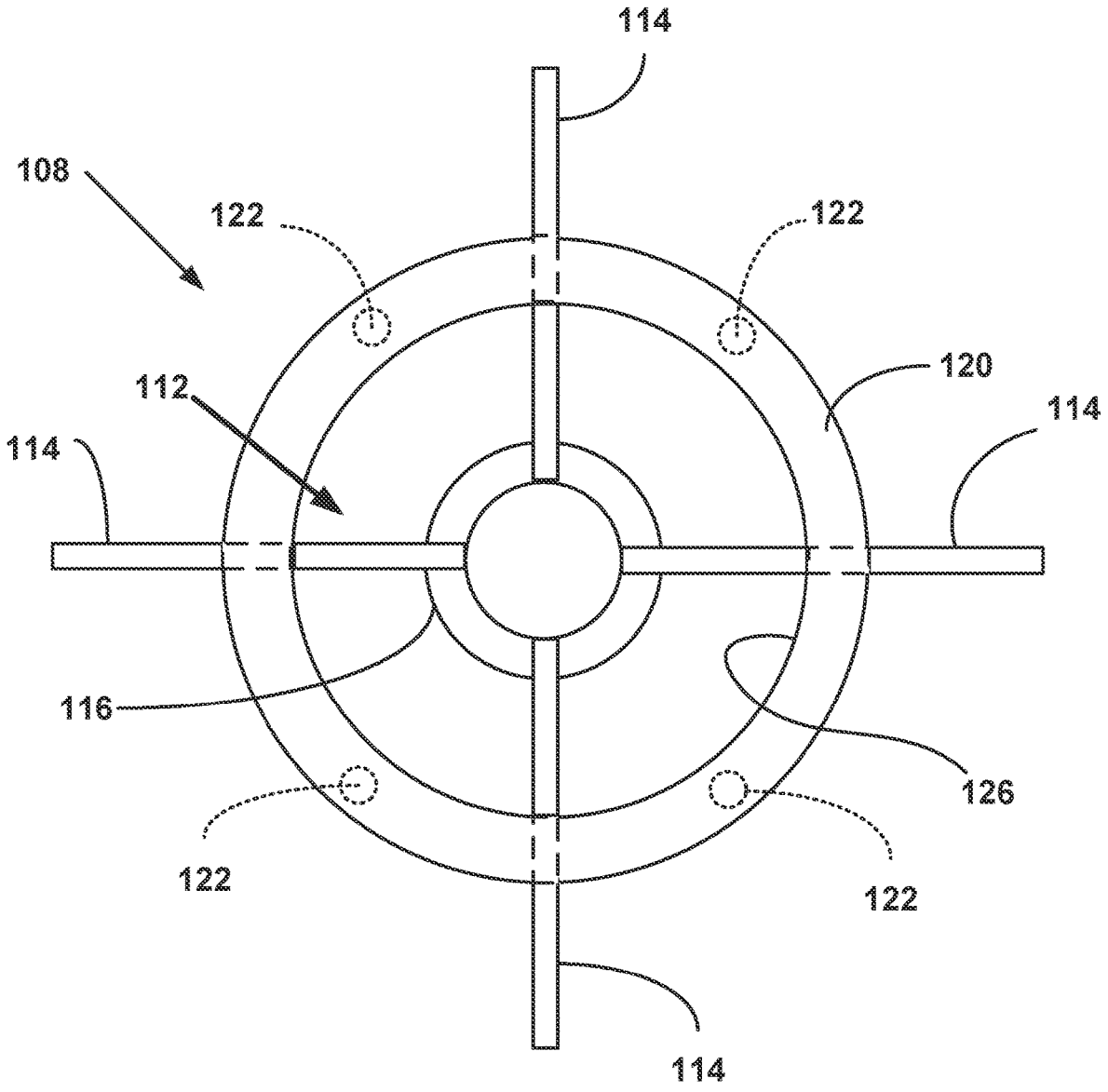
FIG. 20 is a plan view of the nozzle positioning and securing mechanism of FIG. 17, with the nozzle and centering cone removed for clarity.
Figure 22:
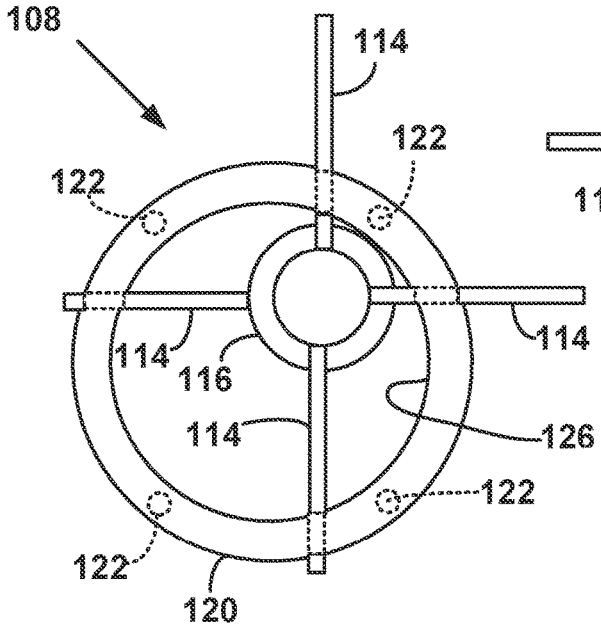
FIGS. 21 to 24 are plan views of the nozzle positioning and securing mechanism of FIG. 20, showing four possible extreme positions of the mechanism.
Figure 21:
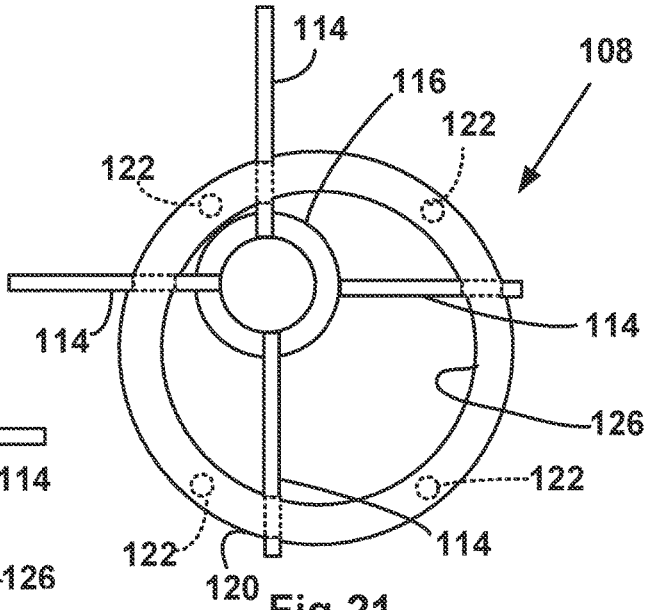
Figure 24:
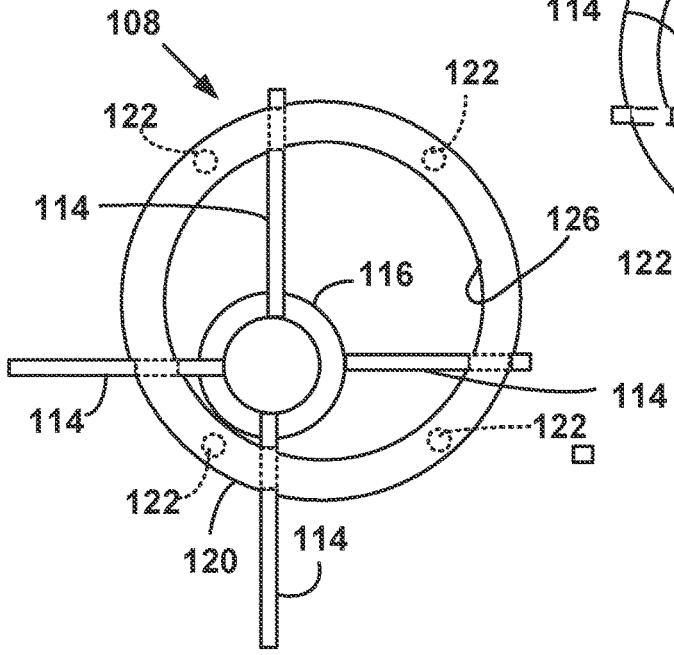
Figure 23:
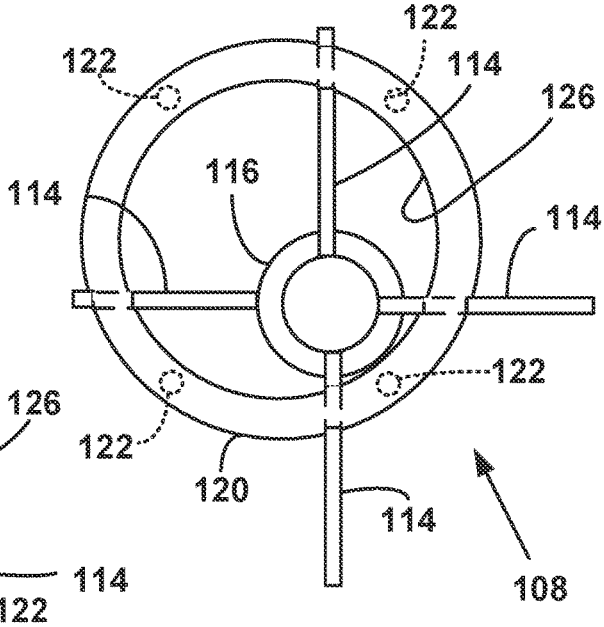

The operator 20 now locks the cross 112 of the nozzle positioning and securing mechanism 108 (for instance by actuating an electromagnet, as described earlier). Then the operator lowers the positioning frame 94 and removes the centering cone 110 from the nozzle 106, as shown in FIGS. 18 and 27. Since the base 34 is locked against movement relative to the lower tubesheet 14 by means of the telescoping legs 35 of the base 34, and since the cross 112 and its corresponding nozzle 106 are locked against movement relative to the positioning frame 94, the longitudinal axis of the nozzle 106 will again be aligned with the longitudinal axis of the tube 16 to be cleaned when the locked stop pins 96 again abut the tubesheet 14. The user once again raises the positioning frame 94 until the locked stop pins 96 once again contact the bottom surface of the lower tubesheet 14, as shown in FIG. 19.

Once the limit switch 104 is satisfied (indicating the positioning frame 94 is firmly against the bottom tubesheet 14), the operator 20 stands back and presses a deadman switch (not shown) which allows the pressurized air/grit mixture to flow through the nozzle 106 for a prescribed period of time to grit blast the tube 16. Upon completion of the cycle, the operator releases the deadman switch to reset the timer, retracts the telescoping legs 35, and moves the base 34 and the device 92 to the next reactor tube 16 to be grit blasted. While the grit blasting arrangement 92 is being repositioned, the grit pot (not shown) may be depressurized, refilled, and re-pressurized for the next cycle. (The control arrangement for the grit blasting is shown in FIG. 42.)

FIGS. 28-33 show another embodiment of a grit blasting arrangement 152 which may be used to clean out reactor tubes which are not conveniently surrounded or bookended by open tubes. This grit blasting arrangement 152 is also mounted on the same type of base 34 described earlier. The grit blasting arrangement 152 rides atop the positioning base when being repositioned to the general area where the tube to be grit blasted is located.

The grit blasting arrangement 152 includes at least one carriage 154 mounted for translational motion along tracks 156, 156'. The tracks 156 156' are secured to the positioning base 34 (not shown in FIG. 28). The carriage 154 is supported by upper and lower sets of wheels 158, 158' mounted to axles 160 attached to brackets 162 which are, in turn, attached to the carriage 154. In the configuration shown in FIG. 28, the carriage 154, and therefore the grit blasting arrangement 152, is set up for grit blasting upwards from the bottom tubesheet (as shown in some detail in FIG. 31), wherein the top set of wheels 158 ride atop the top set of tracks 156 (Note that the tracks 156 and 156' are secured to the positioning base, as noted above). If the grit blasting is to be carried out downwards from the top tubesheet (as shown in some detail in FIG. 32), the arrangement 152 would be inverted, and the second set of wheels 158' would be riding atop the second set of tracks 156'.

A proximal frame 164 (which is secured to the air slide 62 mounted on the carriage 154) provides a first anchor point for a spring 166 which is in turn secured to and supports a distal positioning frame 168. The spring 166 provides flexional support for the high pressure hose 170 which conveys the grit laden high pressure air stream of compressed air to grit blast the inside of the reactor tubes, as described in more detail later. The spring 166 allows for a degree of misalignment between the carriage 154 and the alignment fixture 182, described in more detail later.

Mounted onto the distal positioning frame 168 is an LED light 172 to assist the operator in seeing the positioning of the alignment fixture 182. Also mounted to the distal frame 168 is a camera 174 so that the alignment procedure may be recorded for future reference and/or may be viewed in real time to assist in supervising the operator(s) from a remote location. Also mounted to the distal frame 168 is a laser 176 for use with an automated tracking mechanism to keep track of the tubes 16 which have been grit blasted. A laser tracking system similar to the laser tracking system disclosed in the Johns, et al. U.S. Pat. No. 7,913,543, "Method of using a device for measuring the back pressure in chemical reactor tubes", dated Mar. 28, 2011, which is hereby incorporated herein by reference, may be used for this automated tracking system.

Extending beyond the distal frame 168 is the hose 170, on which are mounted a connector 178, a nozzle 180, and the alignment fixture 182. The connector 178 allows the operator to quickly replace the nozzle 180 and alignment fixture 182 assembly for the correct size depending on the inside diameter of the reactor tubes 16. This allows the same basic grit blasting arrangement 152 to be used for a wide range of tube diameters. The nozzle 180 is the same as the nozzles described earlier, such as the nozzle 106 of FIG. 15.

The air slide 62 on the carriage 154 is identical to the air slide 62 of FIG. 8 which already has been described above. The air slide 62 lifts (or lowers in the event that the grit blasting is to take place from the top down instead of from the bottom up) the proximal frame 164 as well as everything connected to the proximal frame 164 through the spring 166.

Figure 28:
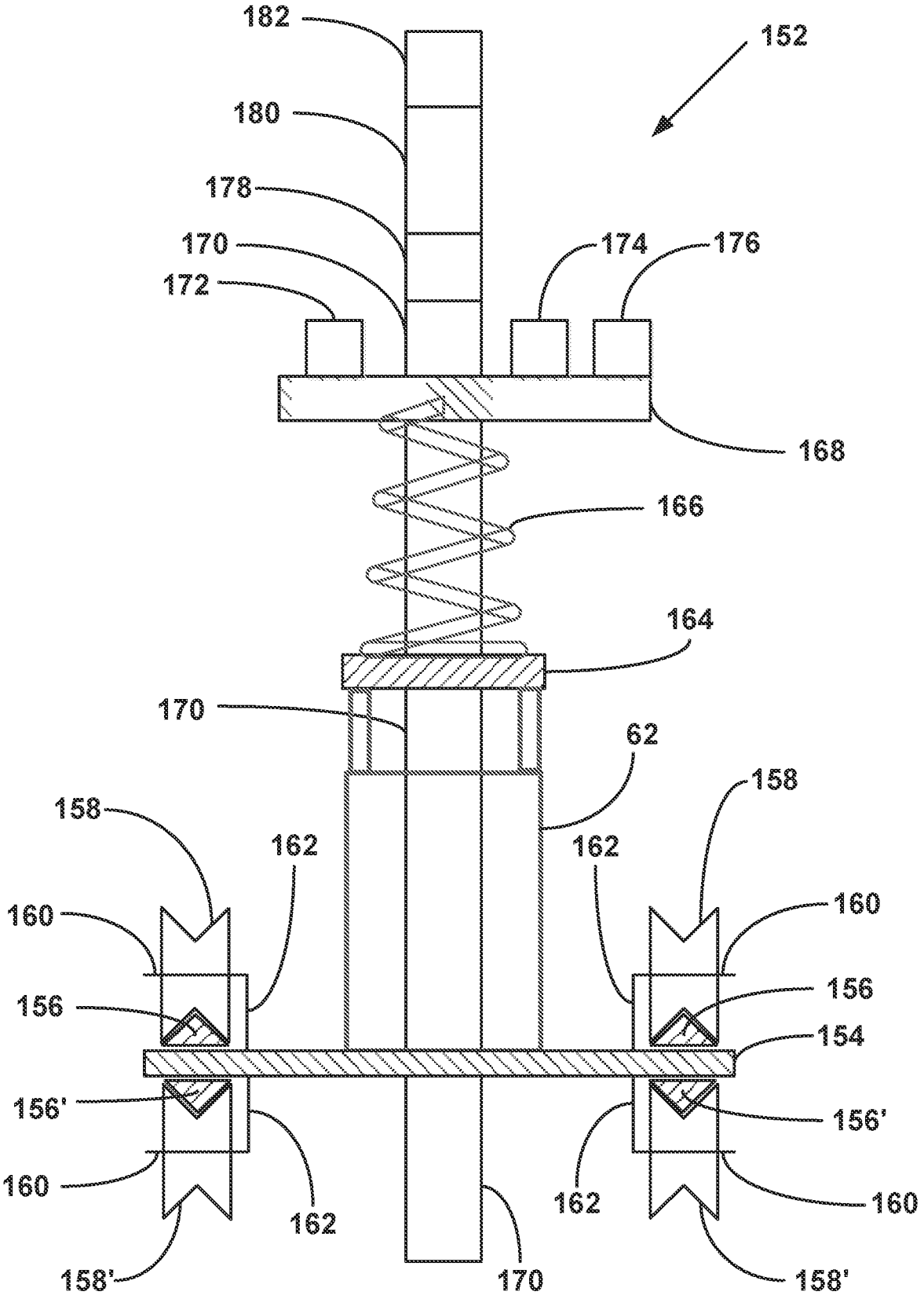
FIG. 28 is a schematic, broken-away side view, partially in section, of another arrangement for grit blasting the inner surface of one tube of a reactor vessel.
Figure 30:
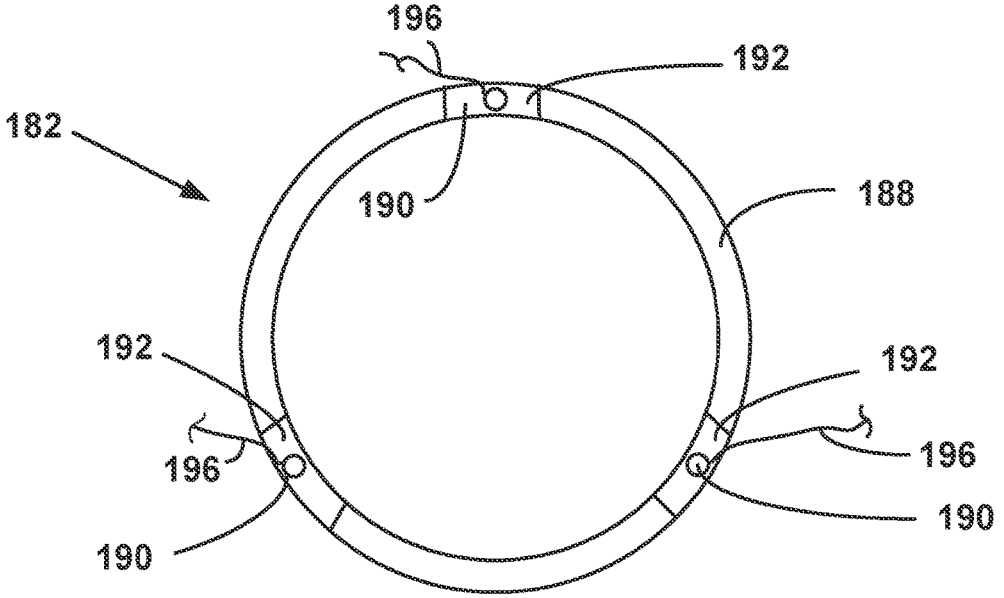
FIG. 30 is a plan view of the alignment fixture of FIG. 28-29.
Figure 29:
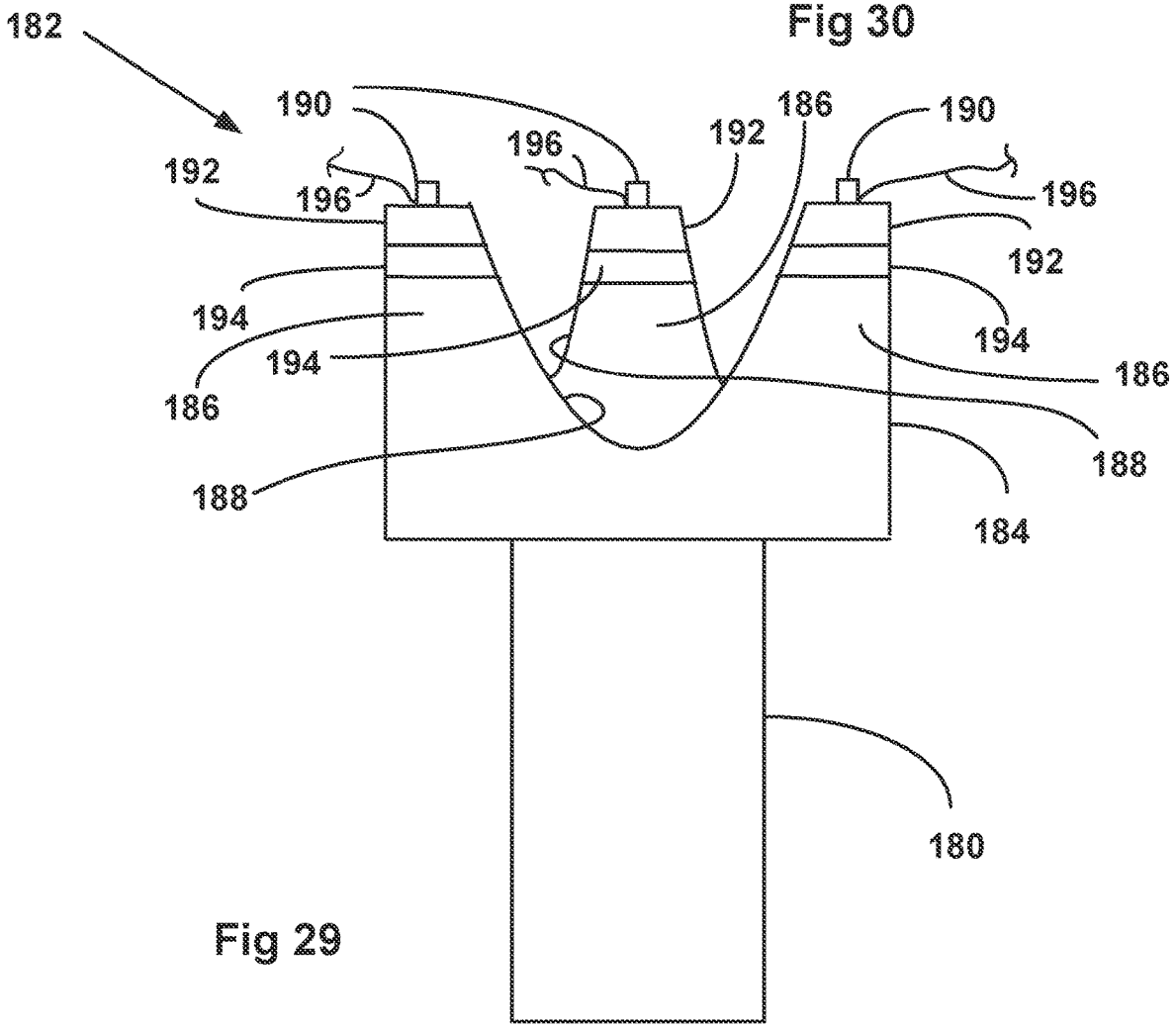
FIG. 29 is a side view of the alignment fixture of FIG. 28.
Figure 31:
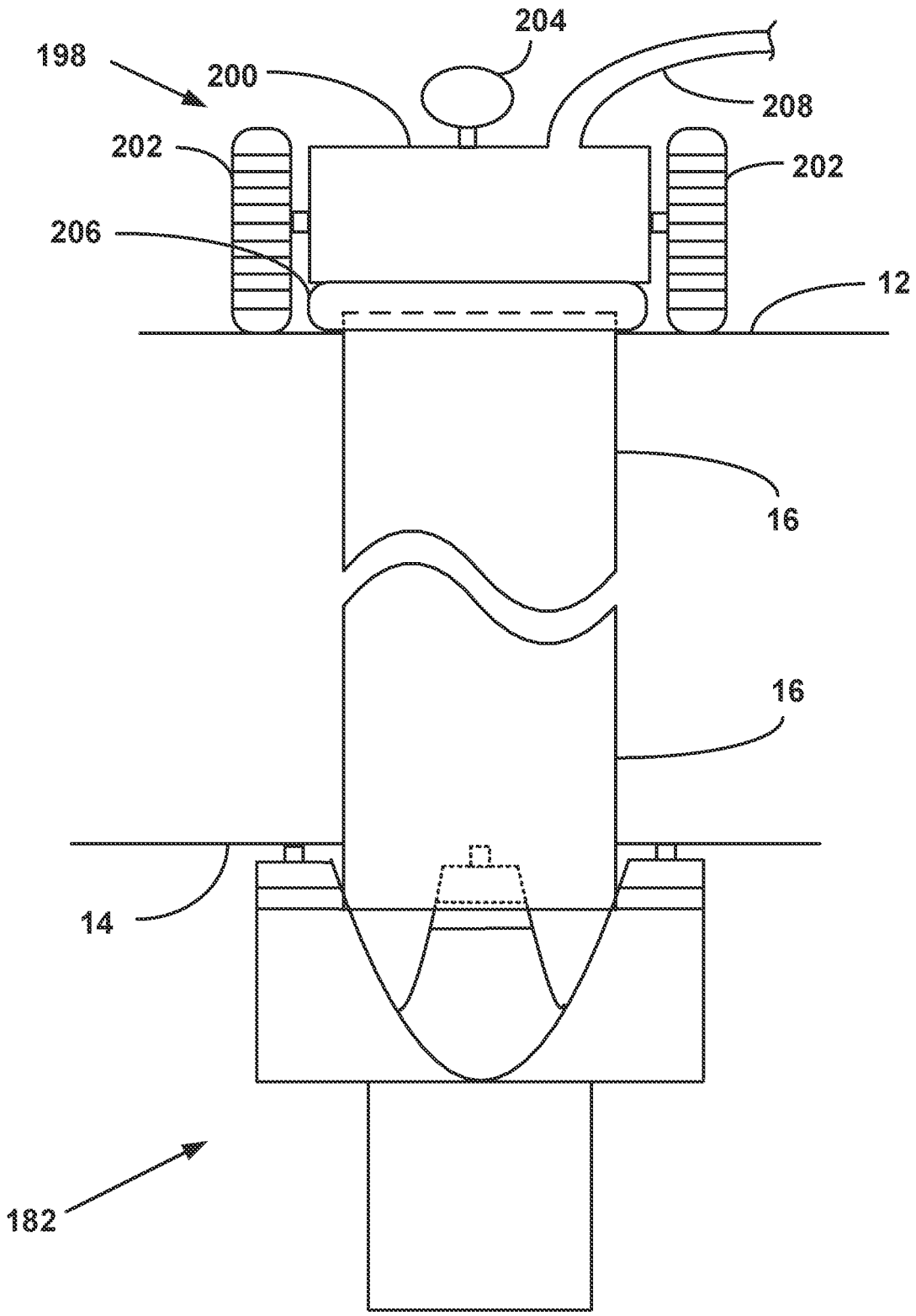
FIG. 31 is a side view of the alignment fixture of FIG. 29 abutting the bottom tubesheet and aligned with a reactor tube, with a vacuum device mounted on the upper tubesheet and aligned with the same reactor tube.

FIGS. 29-31 show the alignment fixture 182 of FIG. 28 in more detail. The alignment fixture 182 resembles a shallow cup 184 with three upwardly projecting wings 186 defining windows or valleys 188 in between these wings 186. At the end of each wing 186 are an electrical insulator 194, a pad 192, and a tip 190. Connected to each tip 190 (or to its corresponding pad 192) is an electrical lead 196 which is electrically connected to a portable power source (such as a small, low voltage cell, not shown). The cell is in turn electrically connected to a low-power-draw light source (such as an LED light, not shown) which in turn is electrically grounded to the respective tubesheet 12 or 14 of the reactor.

As the tip 190 of one of the wings 186 contacts the tubesheet surface, it completes an electrical circuit, which results in its corresponding LED light being illuminated. When all three tips 190 of the alignment fixture 182 are in contact with the surface of the tubesheet, all three of their corresponding lights will be lit. Since three points determine a plane, when all three tips 190 are in contact with the tubesheet, a condition that is indicated by all three lights being lit, then the plane defined by the three tips 190 is parallel to the tubesheet, and therefore the longitudinal axis of the alignment fixture 182 is perpendicular to the reactor tube to be grit blasted, as best shown in FIG. 31.

Figure 32:
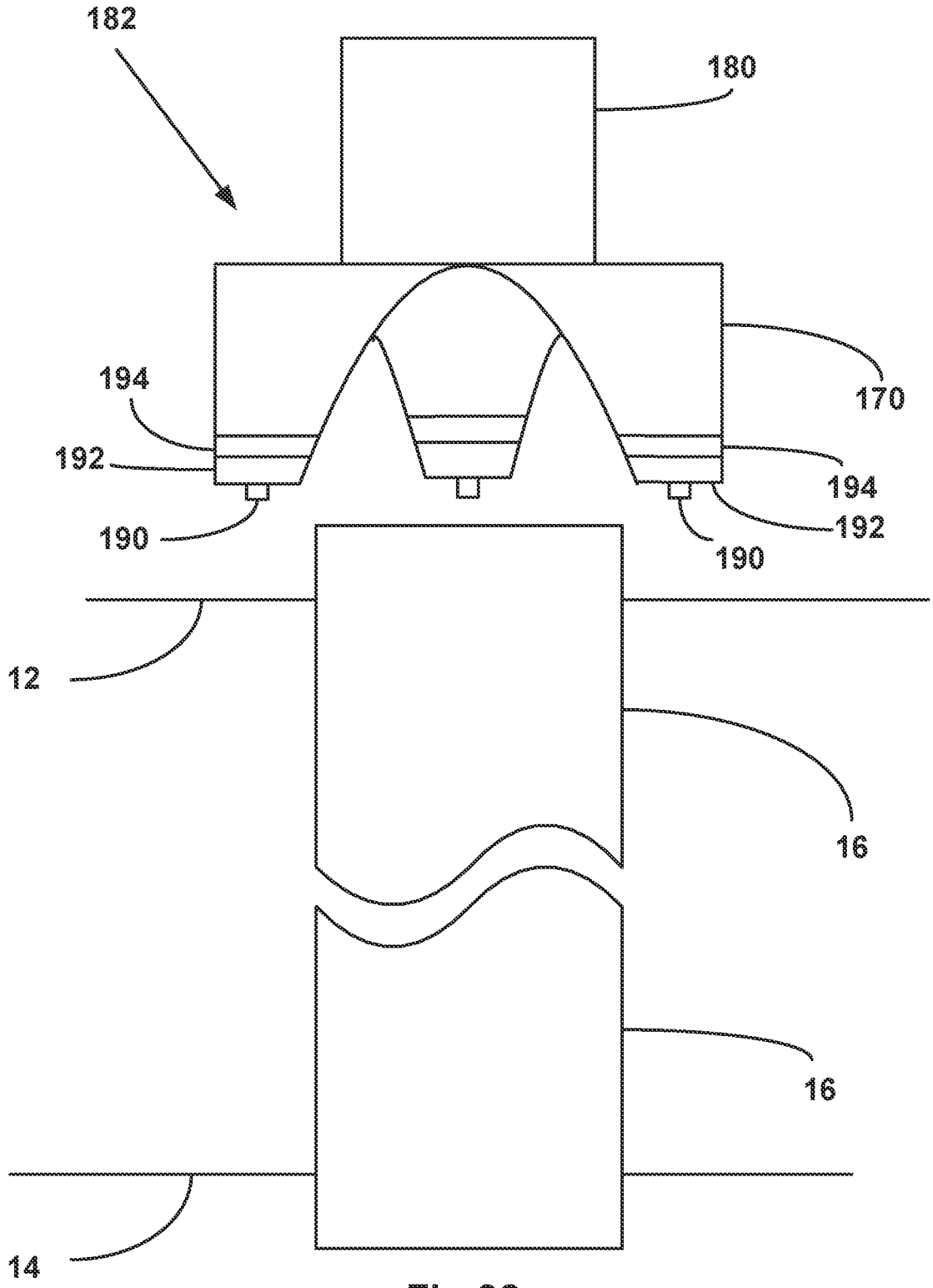
FIG. 32 is a side view of the alignment fixture of FIG. 29 inverted and approaching the upper tube sheet for use in grit blasting the inner surface of the reactor tube from the top end towards the bottom end.

This grit blasting arrangement 152 works even when the ends of the reactor tube 16 extend or project beyond the surface of the tubesheet 12 or 14, as shown in FIGS. 31 and 32, since the tube extension can project beyond the tips 190 and into the alignment fixture 182, as seen in FIG. 31.

Figure 37:
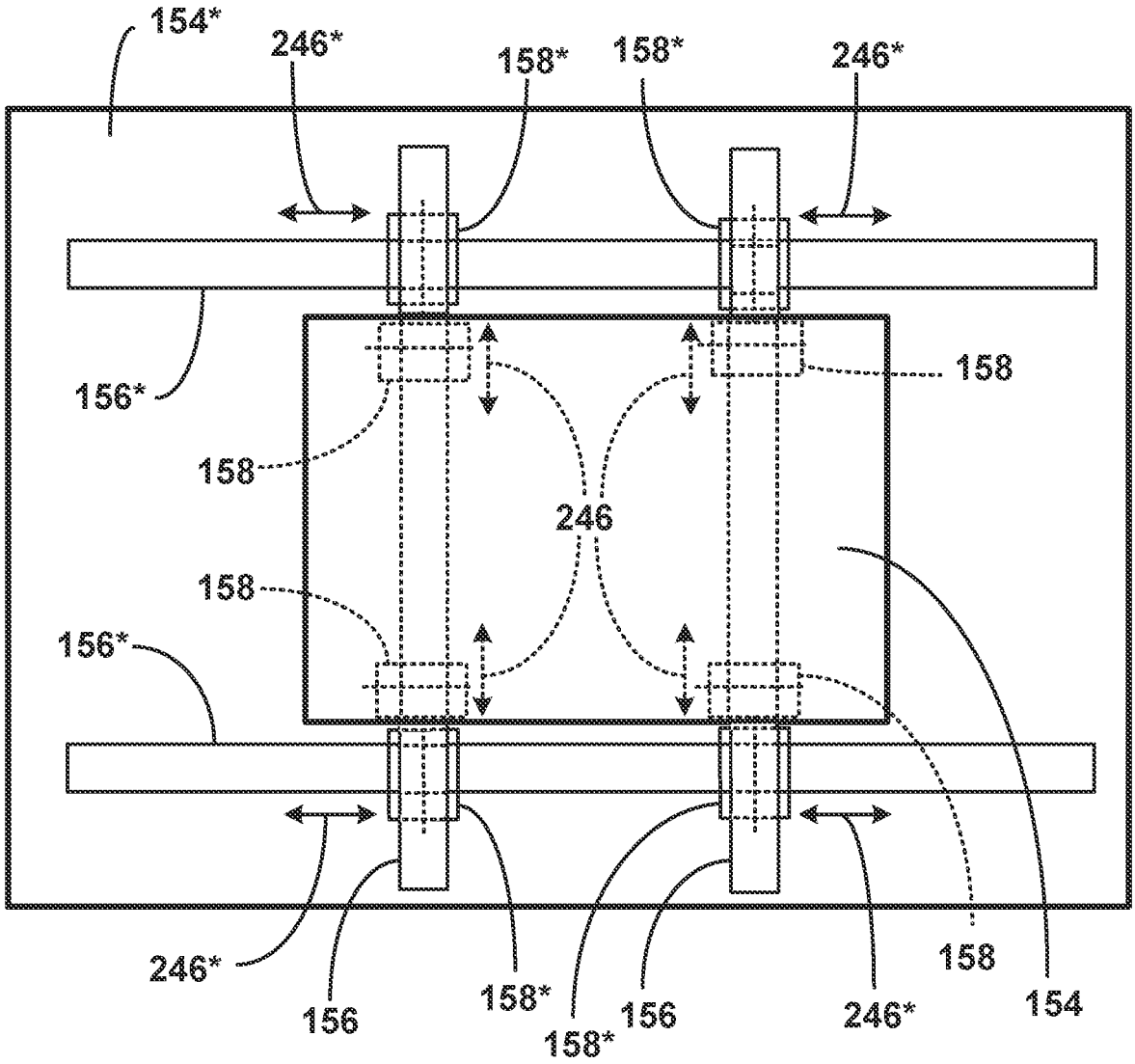
FIG. 37 is a plan view of two sets of tracks which may be used to place the grit blast arrangement of FIGS. 28-32 directly below the tube to be grit blasted.

To use this grit blasting arrangement 152, the operator places the grit blasting arrangement 152 below the reactor tube 16 to be grit blasted. He then does fine adjustments to the position of the alignment fixture 182 by rolling the carriage 154 along its tracks 156 (156'). A second set of tracks which run perpendicular to the first set of tracks 156 (156') may be used to provide adjustment in the perpendicular direction to help place the alignment fixture 182 directly below the tube 16 to be grit blasted. This second set of tracks is shown in FIG. 37, and explained in more detail later.

Once the carriage 154 is moved to align the alignment fixture 182 beneath the tube 16, the air slide mechanism 62 is activated by the operator to raise the alignment fixture 182 until the three tips 190 impact against the tubesheet. The spring 166 allows for a final, automatic correction to ensure full coaxial alignment of the alignment fixture 182 (and thus of the nozzle 180) with the longitudinal axis of the reactor tube 16. When everything is properly aligned, the three lights will light up indicating full proper alignment, and the operator can proceed to depress the deadman switch to initiate the grit blasting procedure.

FIG. 31 also shows a grit evacuation arrangement 198 resting on the top tubesheet 12, above the tube 16 being grit blasted. This is a robotic or drone device and includes a main body 200 with wheels 202, which may be remotely manipulated to place the main body 200 directly over one or more open ends of reactor tubes 16. An omnidirectional camera 204 may be used to assist the robotic device operator in placing the grit evacuation arrangement 198 in the desired spot. A skirt 206 along the bottom perimeter of the main body 200 may be used to provide a "seal" between the main body 200 and the top opening of the tube 16. Alternatively, the body 200 of the grit evacuation arrangement 198 may be raised slightly when relocating the grit evacuation arrangement 198 to a new position over a tube 16, and then lowered slightly onto the tubesheet 12 when the grit evacuation arrangement 198 arrives at its desired location to provide a seal between the grit evacuation arrangement 198 and the upper tubesheet 12.

A flexible conveyance device 208, such as a hose, is used to provide fluid communication between a vacuum source (not shown) and the main body 200 of the grit evacuation arrangement 198 so as to draw out any grit and scale as it is blasted out of the tube 16. The grit and scale being evacuated from the tube 16 by the grit evacuation arrangement 198 may be disposed of in a number of different ways. For instance, it may simply be removed from the reactor 10 (See FIG. 1) via a manway 17 through the top dome 13 and placed directly into drums or super sacks for final disposal by the facility. Alternatively, it may be directed back down through one or more reactor tubes 16 to be captured into drums or super sacks directly beneath the tube(s), thus using one or more of the tube(s) 16 as a grit return conveyance device. Since this grit is being returned via the force of gravity, and since more than one tube 16 may be used to return this grit to the bottom dome 15, the grit blasting effect on the return tube(s) should be minimal.

FIG. 32 shows the grit blasting arrangement 182 being inverted and used to grit blast downwardly from the top tubesheet 12.

Figure 33:
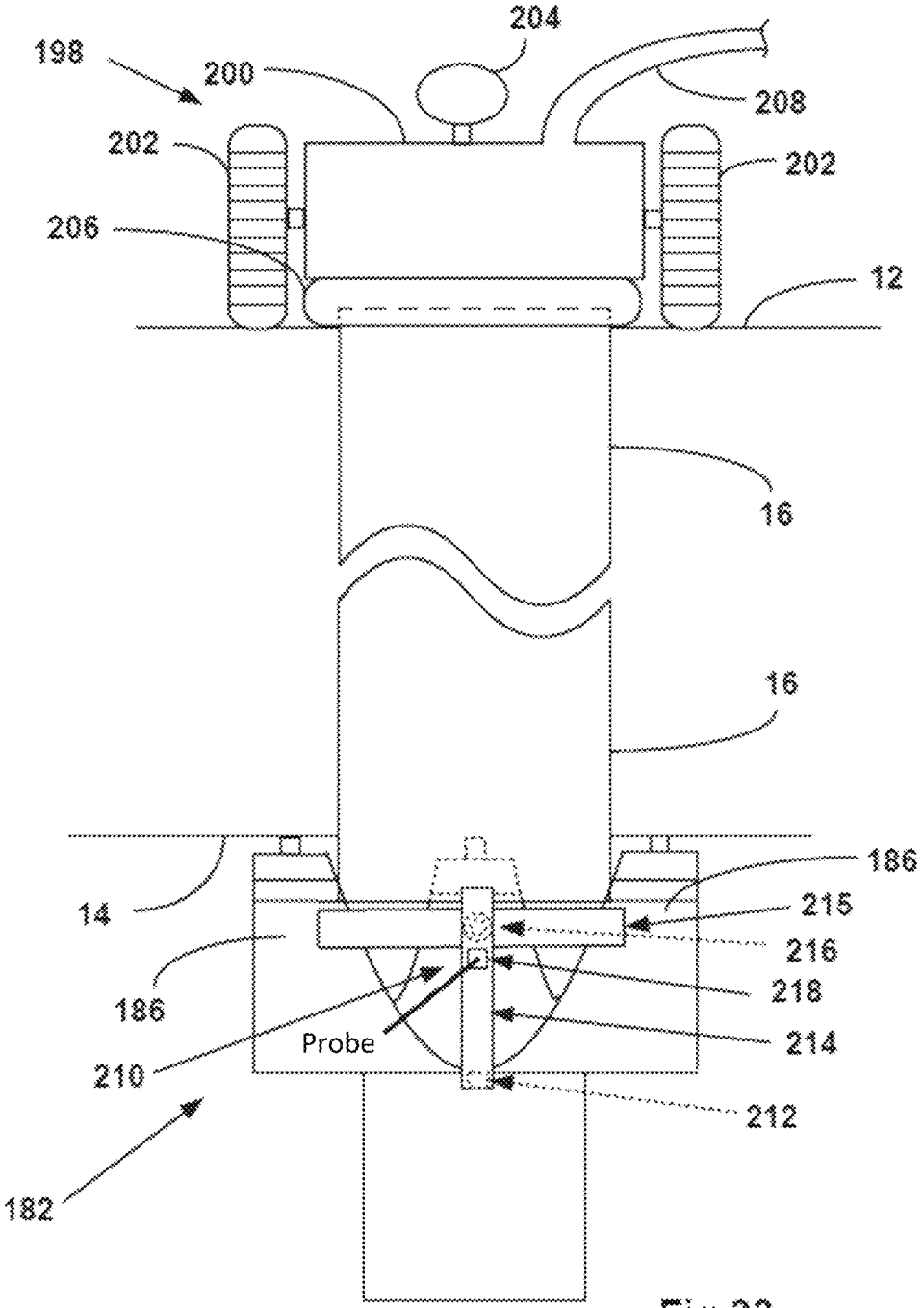
FIG. 33 is a side view of an alignment fixture, identical to that of FIG. 31 but with a vacuum sensing device.
Figure 33B:
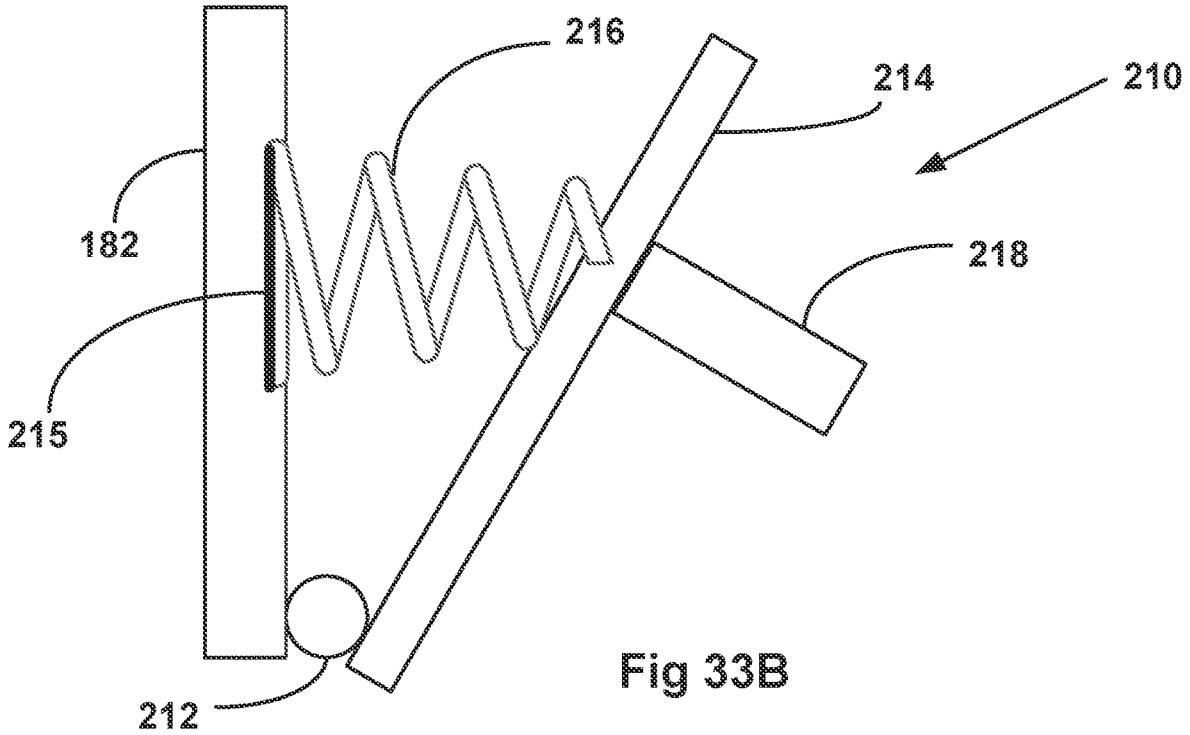
FIG. 33B is the same view as FIG. 33A but wherein the reed is at rest against the proximity probe to prevent grit blasting from commencing.
Figure 33A:
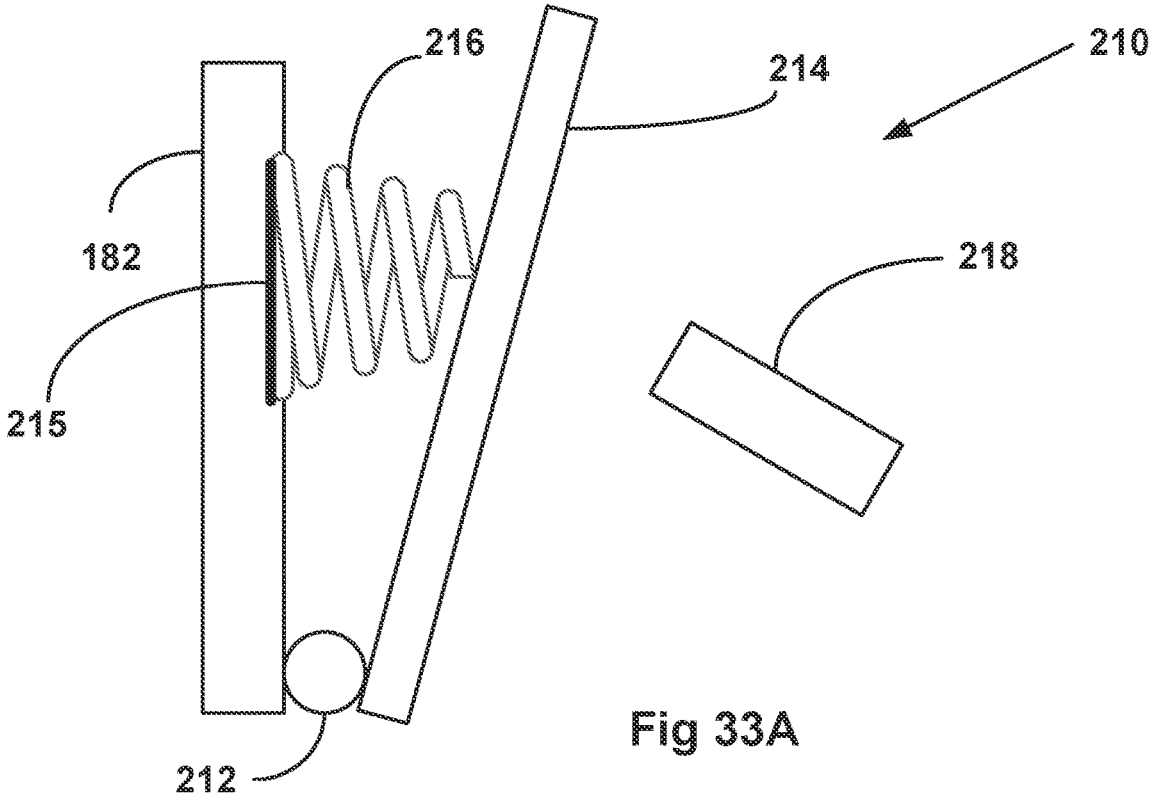
FIG. 33A is a broken-away, side view of the vacuum sensing device of FIG. 33, wherein the reed is pulled away from the proximity probe to allow grit blasting to commence.

If the upwardly-directed grit evacuation arrangement 198 of FIG. 31 is used, it is advantageous to have a way to ensure that the grit evacuation arrangement 198 is located above the correct tube 16 before beginning the grit blasting procedure. FIGS. 33, 33A, and 33B include a vacuum sensing device 210 incorporated into the alignment fixture 182 of FIGS. 29 and 30 to signal when vacuum is present in the tube 16 so that grit blasting may be started by the operator. The vacuum sensing device 210 is mounted in a space between two of the wings 186 of the alignment fixture 182. It includes a thin reed or blade 214 mounted by means of a hinge 212 to the alignment fixture 182. A strap 215 is mounted to two of the wings 186 and spans the space between them. A proximity probe 218 is mounted on the alignment fixture 182 spaced outwardly away from the strap 215 and slightly below the strap 215. A soft spring 216 is mounted on the strap 215 and pushes against the top portion of the reed 214, biasing the reed 214 away from the strap 215 and toward the proximity probe 218, as shown in FIG. 33B.

As long as there is no vacuum in the tube 16, the reed 214 is at rest adjacent to the proximity probe 218, at which point a control switch (not shown) is open so that the operator can't turn on the grit blasting.

When the grit evacuation arrangement 198 is above the correct tube 16 (as in FIG. 31) with the vacuum turned on, and when the alignment fixture 182 is properly located on the bottom of the tube 16, the air rushing in through the spaces between the wings 186 of the alignment fixture 182 (due to the vacuum caused by the grit evacuation arrangement 198 above the tube 16) causes the reed 214 to be drawn in against the spring 216 and away from the proximity probe 218, as shown in FIG. 33A. The proximity probe 218 then closes the switch on the low voltage control circuit that allows the operator to turn on the high pressure air/grit mixture to begin grit blasting.

As mentioned above and as shown in FIG. 37, there may be a second set of tracks 156* and wheels 158* supported on a second carriage 154* upon which the first carriage 154 rides. This second carriage 154* is preferably set up so that the first sets of tracks 156 may have translational motion (indicated by the bidirectional arrows 246*) in a direction perpendicular to that of the translational motion (indicated by the bidirectional arrows 246) of the first carriage 154, allowing the alignment fixture 182 (which is supported on the first carriage 154) to be moved to any position along an X-Y coordinate axis which is substantially parallel to the bottom tubesheet 14.

The first carriage 154 rests upon (or is supported by) the wheels 158 which are able to roll in a first direction (indicated by the bidirectional arrows 246) atop the first set of tracks 156. This first set of tracks 156 is in turn supported by the wheels 158* which are able to roll in a second direction indicated by the bidirectional arrows 246*) atop the second set of tracks 156* and which is substantially perpendicular to the first direction 246. The second set of tracks 156* is supported by the second carriage 156*.

One of the problems with grit blasting in the prior art is that there has not been an objective procedure for calibrating and gauging the grit blasting and its effectiveness. In the prior art, a first tube is grit blasted, and a borescope is lowered into the tube to try to ascertain the degree to which the grit blasting task is complete. The time required to reach an acceptable level of cleanliness in the tube is measured, and this is the grit blasting time allotted to each of the remaining tubes, assuming the conditions remain fairly consistent across all tubes during the grit blasting process.

Figure 34:
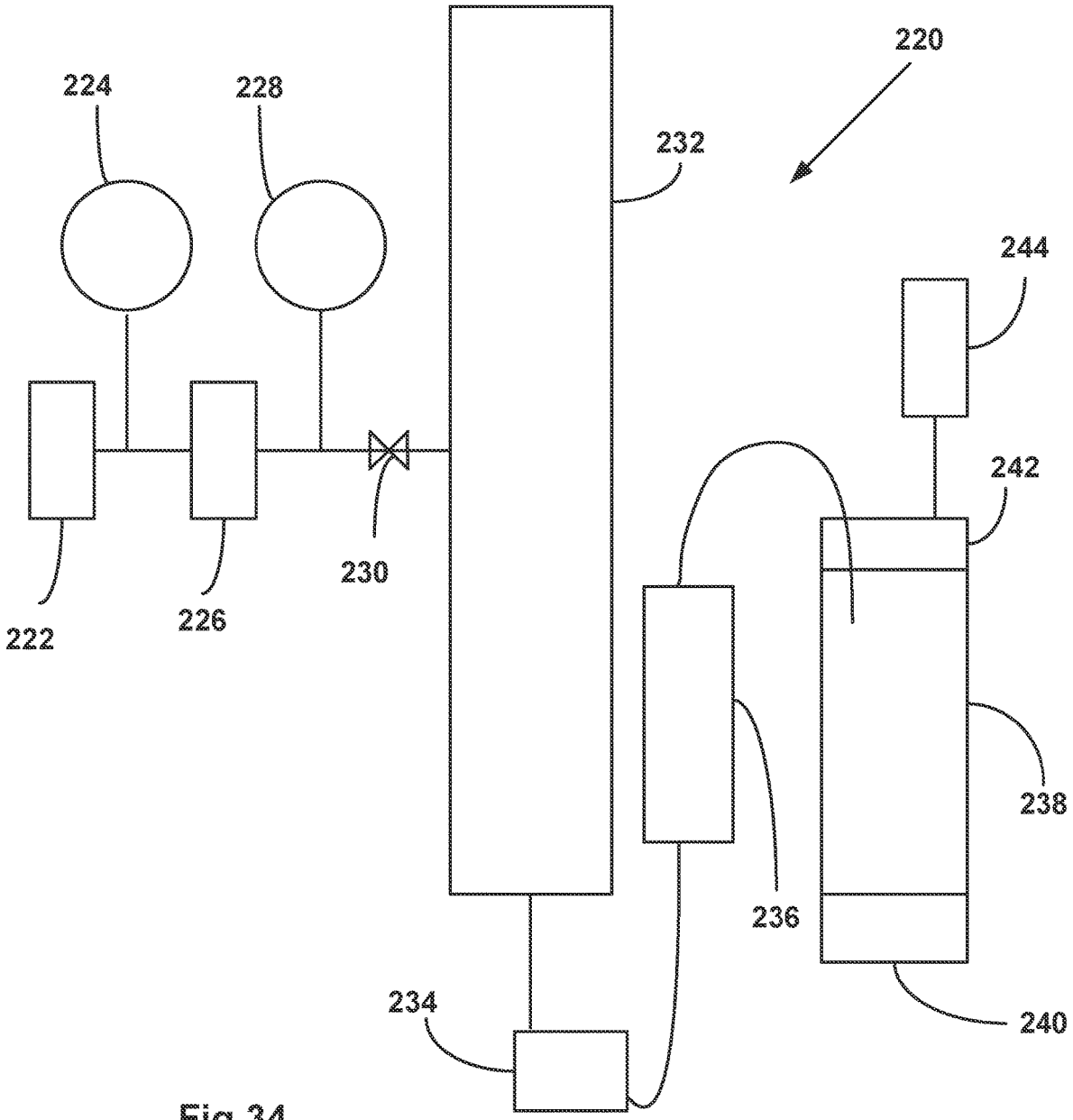
FIG. 34 is a schematic view of a test calibration arrangement to calibrate a grit blasting arrangement.

The device and procedure described below provide an objective and quantifiable method for ascertaining a best operating practice for grit blasting reactor tubes. Referring to FIG. 34, the test calibration arrangement 220 includes a compressed air source 222, a first pressure gauge 224, an orifice 226, a second pressure gauge 228, a solenoid valve 230, a grit pot 232, a grit control valve 234 (typically a pinch valve), a coupon chamber 236, and a grit collection drum 238 on a weight scale 240. The drum 238 has a venturi-powered vacuum lid with filter 242 leading to a vacuum source 244. All the aforementioned items are piped together as shown in FIG. 34.

Figures 35, 36:
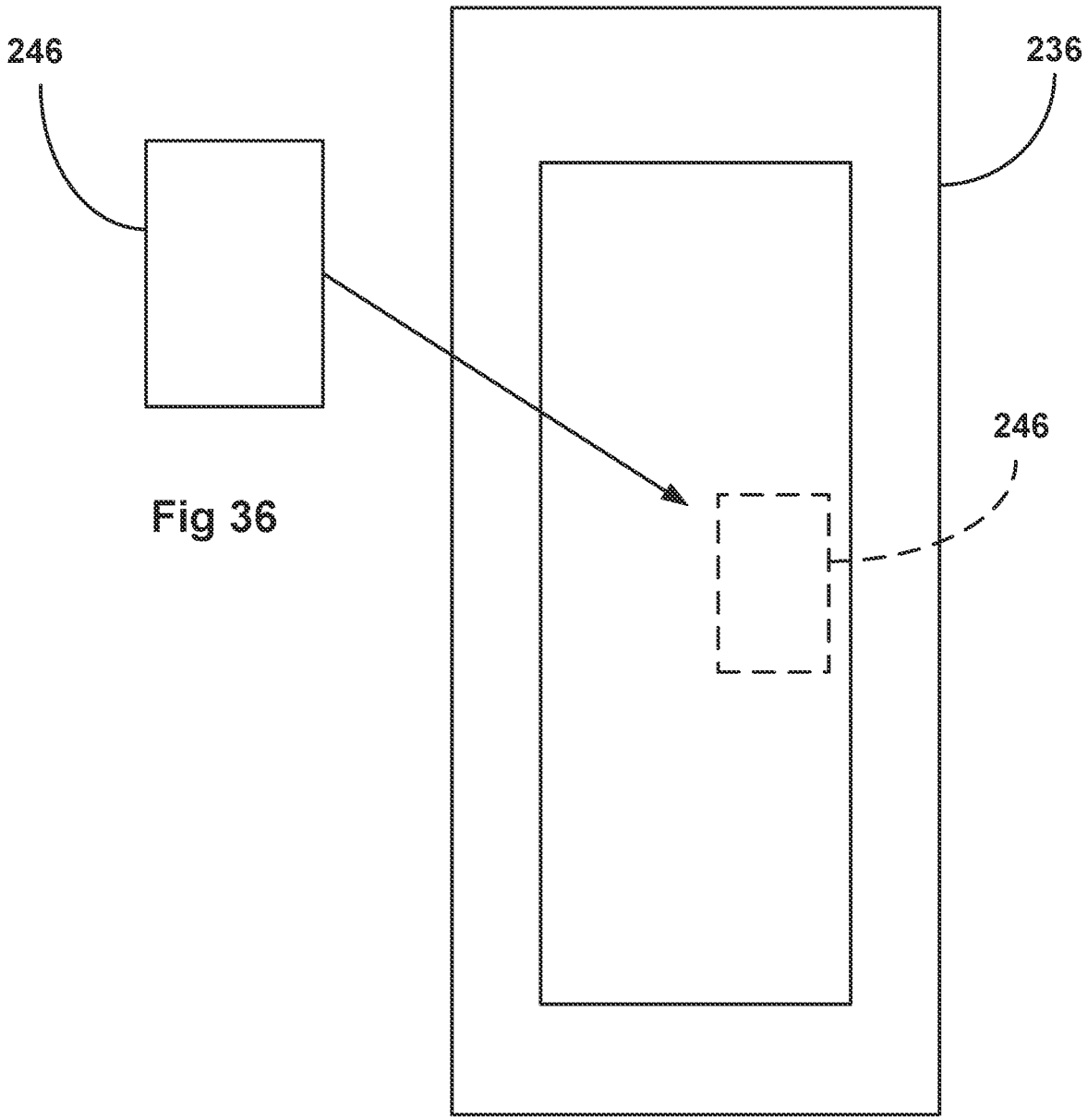
FIG. 35 is a side view of the coupon chamber of FIG. 34.
FIG. 36 is a side view of a coupon used in the coupon chamber of FIGS. 34 and 35.

FIGS. 35 and 36 show schematically the coupon 246 which is installed inside the inside the coupon chamber 236. This abrasion test coupon 246 and the coupon chamber 236 are set up in accordance with ASME or ISO standards for abrasion testing so as to determine the time required to achieve the desired level of cleanliness on the test coupon 246 with the nozzle (not shown) and nozzle orientation to be used in the actual grit blasting process. The procedure is validated by comparing the results of the test coupon blasting with an actual reactor tube 16 grit blasting as deemed by a borescope inspection of the tube after the grit blasting procedure.

To operate the test calibration arrangement 220, the compressed air source 222 is turned on and the air flows through an orifice to establish a steady flowrate despite reasonable fluctuations in the compressed air inlet pressure (as measured by the first pressure gauge 224). The solenoid valve 230 is set to control the flowrate at the desired amount when going into the grit pot 232. The compressed air picks up the grit in the grit pot 232 and the amount of grit and compressed air is further regulated by the grit control valve 234 before it enters the coupon chamber 236 for grit blasting the coupon 236. The compressed air/grit mixture exits the coupon chamber 236 and enters the grit collection drum 238 where the grit is weighed to establish a grit weight per unit of time. The actual abrasion results of the test coupon 246, validated against actual borescoped results in an actual reactor tube at the same operating conditions determine the operating parameters for the grit blasting protocol to be followed for all the tubes in the reactor.

Note that additional tests may be run on test coupons 246 to enable a regression analysis that will determine extrapolated operating conditions in the event of changing operating parameters. For instance, if at the given compressed air operating pressure it is determined that a 10 second grit blast procedure is required to clean a tube; should the compressed air pressure drop by 10% for 2 seconds during the process, the control system can automatically increase the duration of the grit blasting process for that tube to 10.6 seconds, for example.

The final test to validate the grit blasting protocol may well include running a swab the full length of the tube 16 after it has been grit blasted to ensure that there is no rust. The plant may in fact run 100% swab tests on all the tubes to ensure clean, rust free tubes. If the swabs are numbered to ensure that a particular swab is identified with one specific tube, the swabs can be inspected after all the tubes have been swabbed and any swabs showing a rust-colored discoloration can then be traced back to their respective tube for further cleaning.

FIGS. 38-41 show another embodiment of a grit blast arrangement 248 which includes a head assembly 246' which is substantially identical to the head assembly 246 of FIGS. 8-10 (including the positioning frame 42' and all the components mounted on the frame 42', such as the alignment pins 38', the nozzle 40', the elevator stop pins 56', and a proximity sensor 60', as well as an elevator platform 44' and a pneumatic air slide 62'). However, instead of a wheeled base 34 (See FIG. 8), this embodiment uses a base with a crossbeam arrangement 250 to accurately move and place the head assembly 246' where it is needed. Of course, this base with a crossbeam arrangement 250 may be used with any of the head assemblies disclosed in this specification.

The base 251 (See FIG. 40) includes a main, semi-cylindrical, elongated member 260, supported at its first end by two rear feet 252 which come together to a single telescoping rear leg 254 suitable for discrete height adjustments of the rear end of the base 251 using a pin 256 which may be pushed through aligned openings (not shown) in the leg 254 and in the tube support 258. A single wheeled leg 262 supports the elongated member 260 at its second end. This wheeled leg 262 is similar to a trailer jack, allowing infinite (as opposed to discrete) height adjustment of the second end of the base 251. A hand crank 264 is used to raise or lower the second end of the base 251 relative to its first end until the elongated member 260 is substantially horizontal (as measured by a bubble level, for instance, not shown).

Figure 41:
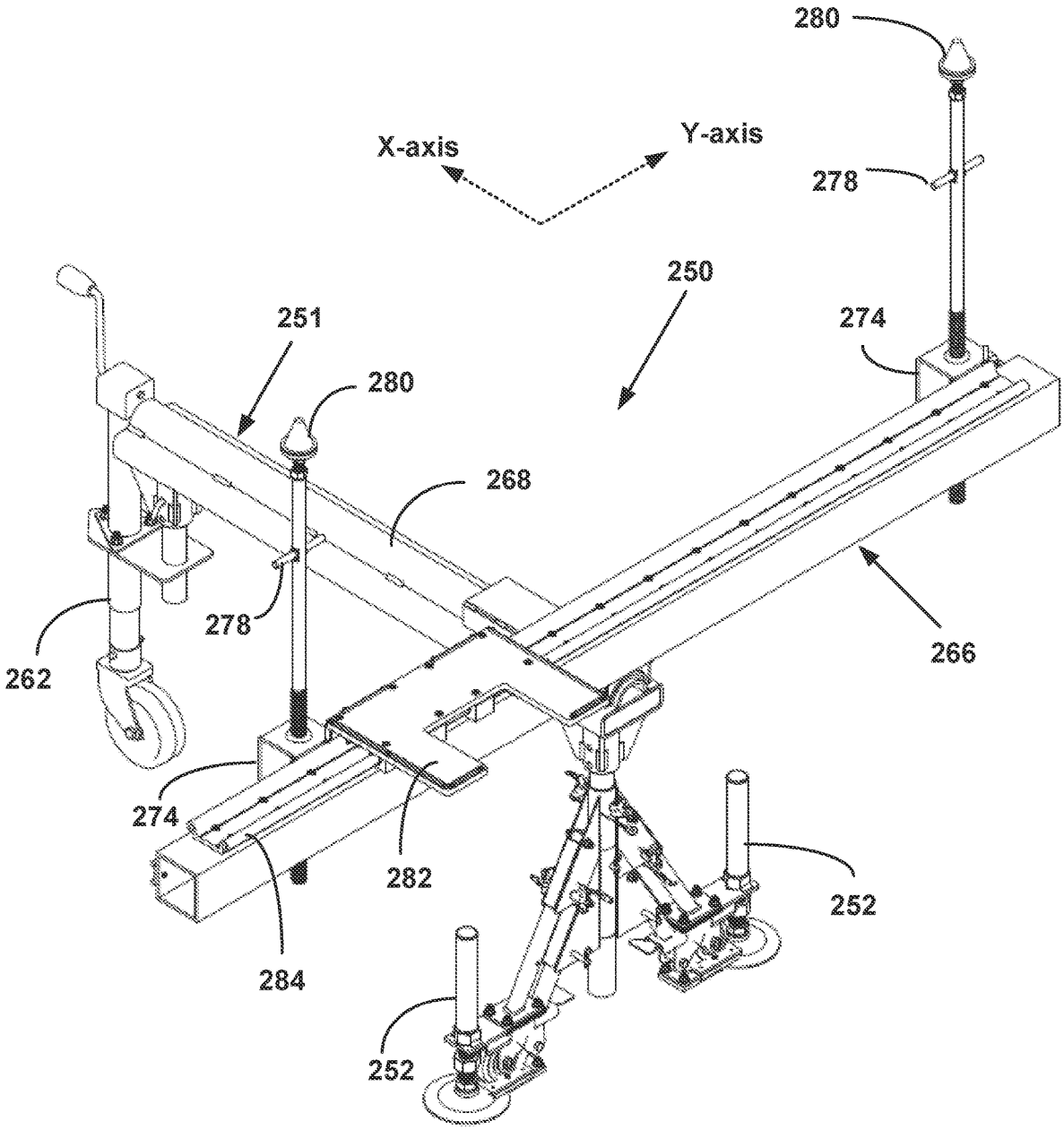
FIG. 41 is a perspective view of the base and crossbeam arrangement of FIGS. 38 and 39.

Referring now to FIG. 41, a crossbeam 266 is designed to rest upon, and slide along the X-axis of, the semi-cylindrical surface 268 of the base 251. A saddle 270 (See also FIG. 39) defines a concave inner surface 272 which matches up with the convex semi-cylindrical outer surface 268 of the base 251 in order for the crossbeam 266 to slide along the X-axis of the base 251. A low friction bearing surface may be inserted between the concave surface 272 of the saddle 270 and the convex surface 268 of the base 251 so as to enable easier displacement of the crossbeam 266 along the elongated member 260.

Figure 39:
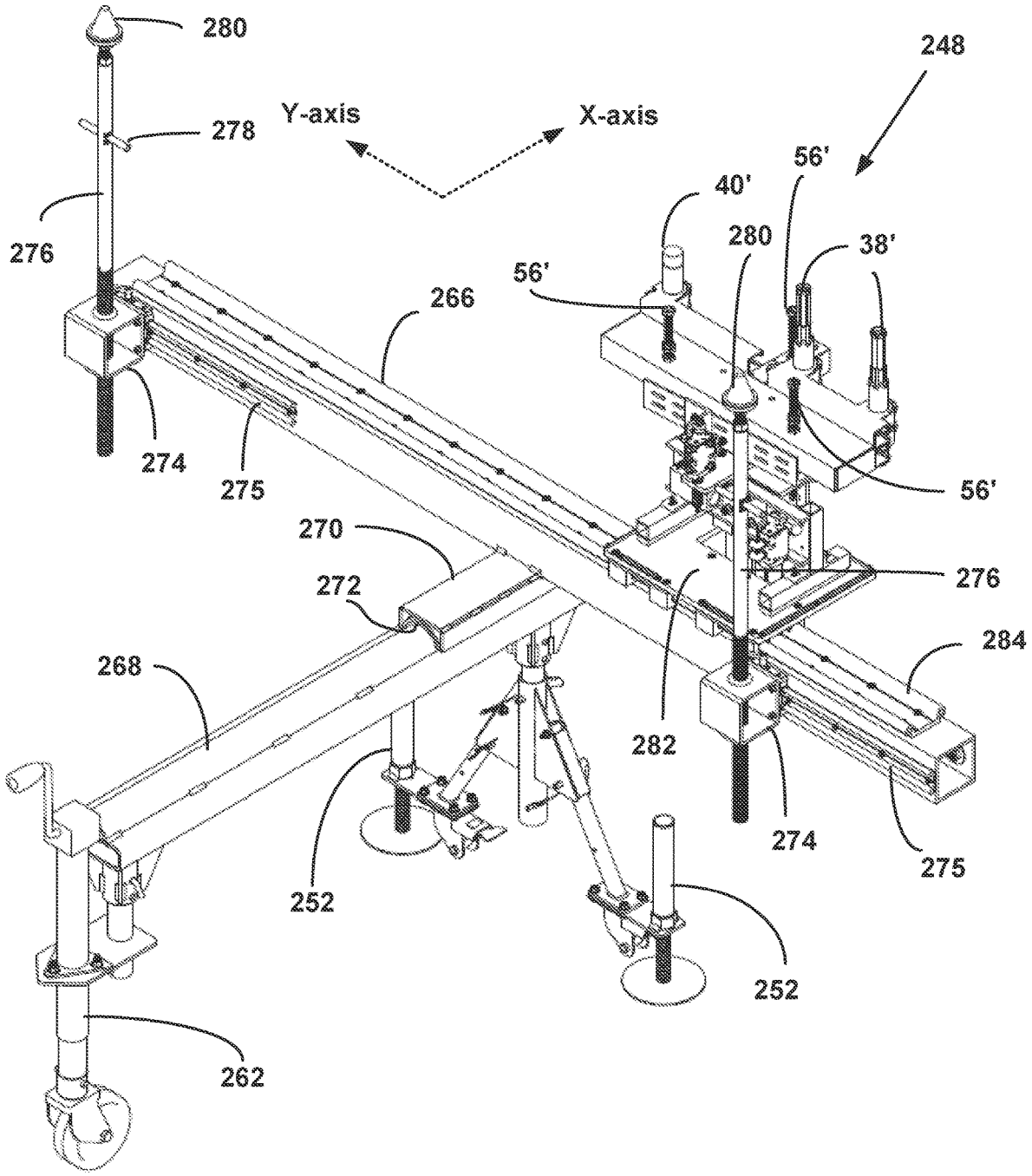
FIG. 39 is an opposite end perspective view of the grit blast arrangement of FIG. 38.
Figure 40:
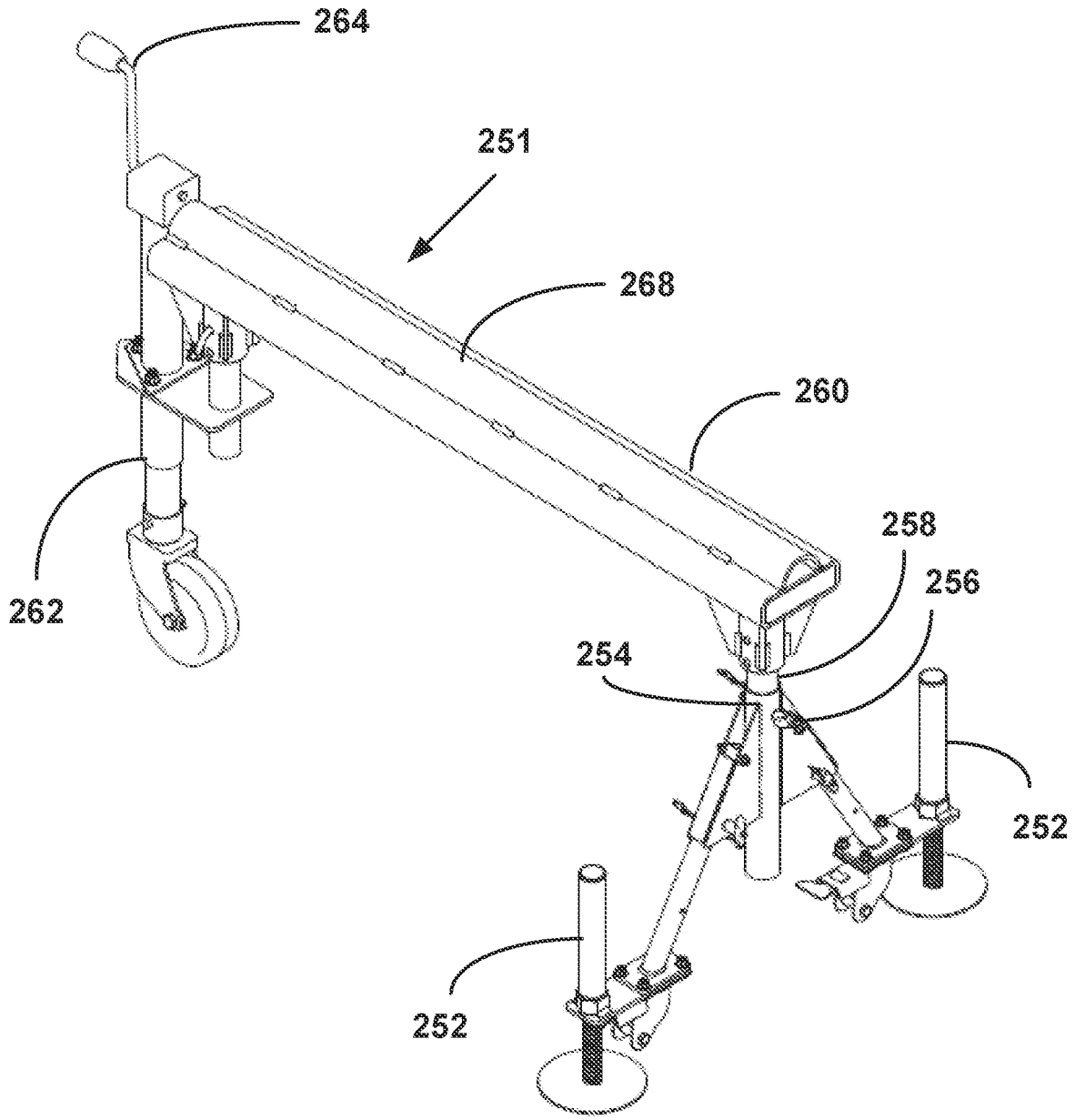
FIG. 40 is a perspective view of the base of FIGS. 38 and 39.

Referring to FIG. 39, two internally threaded boxes 274 are mounted to the crossbeam 266 for slidable displacement on tracks 275 along the Y-axis. Two externally threaded rods 276 engage the internal threads of their respective boxes 274. The distal ends of each rod 276 each define a conical cap 280 designed to go into and engage the bottom end of a tube 16. A crossbar 278 on each rod 276 aids the user in threading the rods 276 into their respective tube ends. During actual operation, the user first sets up the base 251 onto the bottom dome (or on a temporary flooring (not shown) set up on the bottom dome for this purpose) and levels the base 251 so that the elongated member 260 of the base 251 lies on a substantially horizontal plane. He then places the crossbeam 266 so that its saddle 270 rests on top of the elongated member 260 of the base 251 and then proceeds to thread the rods 276 until the conical caps 280 engage the bottom ends of their respective tubes 16. The user may have to move the boxes 274 in their tracks 275 along the Y-axis, and the crossbeam 266 along the X-axis, to ensure proper alignment of each threaded rod 276 with its respective tube end. Once the rods 276 are in their respective tube ends, the user checks to ensure that the crossbeam 266 lies on a substantially horizontal plane (as measured by a bubble level, not shown, placed on the crossbeam 266). If the crossbeam 266 is not lying on a substantially horizontal plane, the user threads in one of the rods 276 while threading out the other of the rods 276 until a substantially horizontal attitude of the crossbeam 266 is achieved.

As the reader may now realize, with the base 251 in substantial horizontal alignment, and the crossbeam 266 mounted orthogonally to the base 251 also being in substantial horizontal alignment, the flat plate 282 (See FIG. 41) which is mounted for lateral displacement on a track 284 along the Y-axis of the crossbeam 266 is also in substantial horizontal alignment.

Figure 38:
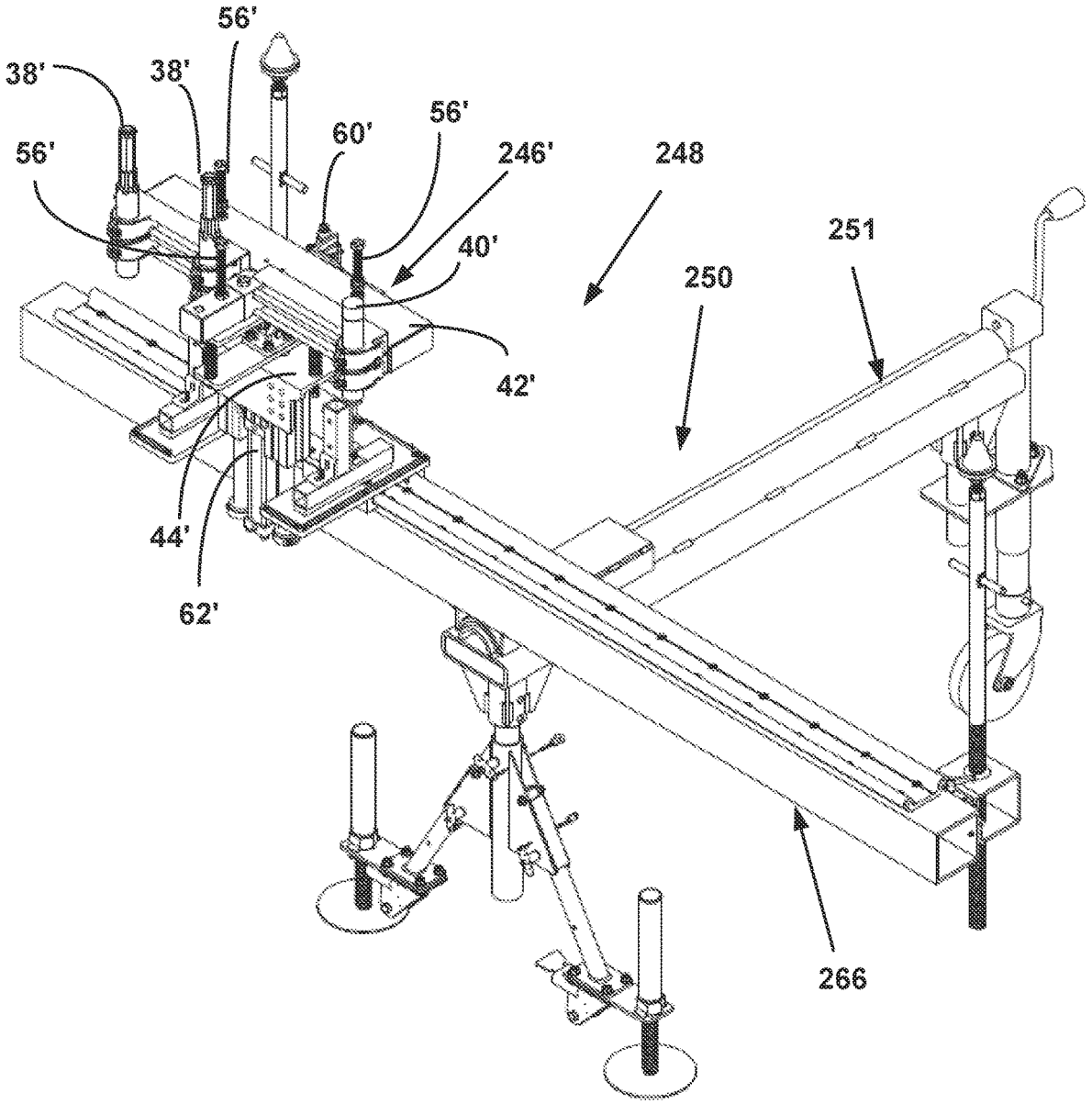
FIG. 38 is a first end perspective view of another embodiment of a grit blast arrangement, similar to that of FIG. 8 but wherein the base has a single wheel and two feet and has a crossbeam mounted on it.

The head assembly 246' rests atop the flat plate 282, as shown in FIGS. 38 and 39, so it may be moved with ease by the user until the alignment pins 38' are aligned with, and inserted into the bottom ends of their respective tubes such that the nozzle 40' is also properly aligned with, and coaxial with, the tube (or tubes) to be grit blasted.

The head assembly 246' is able to be slidably moved with ease over the flat plate 282 for final alignment of the grit blast nozzle(s) 40'. Once the nozzle(s) 40' are in their proper position and alignment (having been raised into position by the pneumatic air slide 62'), with the alignment pins 38" holding the head assembly 246' firmly in place, the user steps back and presses the deadman switch to initiate the timed grit blasting process, as has already been described partially and as described more fully with respect to FIG. 42. Once the grit blasting sequence is complete, the user releases the deadman switch which resets the timer for the next tube. He then lowers the head assembly 246' so that the head assembly 246' may be moved laterally to the next tube(s) to be grit blasted. There may be enough room on the flat plate 282 to relocate the head assembly 246' below the next tube(s) to be grit blasted. However, if this is not possible, the user may reposition the flat plate 282 by sliding it laterally on its track 284, along the Y-axis until a new tube (or set of tubes) can be reached by the head assembly 246'.

Once all the tubes that are accessible along the full length of the crossbeam 266 have been reached and grit blasted, the user unthreads the rods 276 just far enough to enable him to move the crossbeam 266 along the X-axis of the base 251 until the next set of rows of tubes become accessible. He then threads the rods 276 back into their respective tube ends, ensuring that the crossbeam 266 is back in substantial horizontal alignment, and he then proceeds to grit blast the next row of tubes.

Before the user must move the base 251 he can grit blast all the tubes that lie below the footprint defined by the length of the crossbeam 266 (in the Y-axis direction) and the length of the base 251 (in the X-axis direction). Once all those tubes have been grit blasted, the user removes the head assembly 246' from the flat plate 282, he then removes the crossbeam 266 from the base 251, and he then relocates the base 251 in order to access a whole new set of tubes. He proceeds to level the base 251, installs the crossbeam 266 on the base 251 and ensures it is also level, and finally places the head assembly 246' on the flat plate 282 to repeat the grit blasting process on all the tubes that are now accessible from the newly relocated placement of the grit blast arrangement 248.

In the prior art, an electrical deadman switch (not shown) has been used to initiate the grit blasting procedure. That is, when the operator is satisfied that the blast nozzle is properly located in the appropriate tube 16 (see FIG. 5), he depresses an electrical deadman switch which sends an electrical signal to open up the grit blast control valve (BCV) which initiates the flow of grit-laden compressed air through the nozzle 22 to grit blast the inside surface of the tube 16. An electrical short in the electrical line can accidentally initiate the flow of grit-laden compressed air through the nozzle 22 without the operator's knowledge.

FIG. 42 schematically represents a control arrangement used in the present embodiments in order to prevent such an accidental initiation of the flow of grit-laden compressed air through the respective nozzle 40, 40', 106, 180, etc., as explained below.

Referring to FIG. 42, the dotted line 286 represents the reactor vessel wall, so the components inside the reactor vessel 10 (See FIG. 1) are on one side of the dotted line 286, and the components outside of the vessel 10 are on the other side of the dotted line 286.

Inside the reactor vessel are a first pneumatic control valve 288, a second pneumatic control valve 291, a dead man pneumatic control valve 294, and a grit blast nozzle 40, 40'. The first pneumatic control valve 288 is a 5-way, lever-action, pneumatic, directional control valve 288 having an on/off control lever 290. The second pneumatic control valve 291 is a 5-way, plunger-actuated, pneumatic, directional control valve 291 having a plunger 292 (which represents limit switch 60 in FIG. 13, switch 104 in FIG. 17, and switch 60' in FIG. 38). The grit blast nozzle in this arrangement also may be any of the other grit blast nozzles described herein. The lever action valve 288 and the plunger action control valve 291 preferably are mounted directly on the head assembly 246' (See FIG. 30). Outside the vessel are a grit pot 296, a pressure switch 298, and a grit-blast control valve 300 (also referred to as BCV 300). The pressure switch 298 is preferably mounted on or adjacent to the BCV 300.

Each of the first and second 5-way valves 288, 291 has five (5) air-line connection ports, as numbered respectively in FIG. 42. A relatively low pressure compressed air line, for instance 50 PSI, is connected to port 2 of the first valve 288. If the lever 290 of the first valve 288 is in the on position, the valve 288 directs the flow of compressed air from its inlet port 2 to its outlet port 1. From the outlet port 1 of the first valve 288, the air then flows to the inlet port 2 of the second pneumatic valve 291, which is actuated by the plunger 292. If the plunger 292 is satisfied (that is, the plunger 292 is pressed against the tubesheet, indicating that the head assembly 246' is properly located and ready for the operator to initiate the grit blast procedure), the air flows through the second valve 291 to its outlet port 1 and then flows on to the deadman switch (valve) 294. (The plunger 292 may represent any of the limit switches described herein, such as 60 or 104, which press up against the tube sheet.)

When the operator depresses the deadman switch (valve) 294 to initiate the grit blast procedure, the deadman switch (valve) 294 sends the air flow from the outlet 1 of the second valve 291 to the port 5 of the second valve 291. Again, if the plunger 292 is still satisfied, the air flows from the inlet 5 port to the outlet port 3 of the valve 291 and on to the inlet port 5 of the valve 288 and then to its outlet port 4 and on to the pressure switch 298, which, as indicated earlier, is located outside of the reactor vessel 10 and preferably is either mounted on, or is immediately adjacent to, the BCV 300. If the pressure switch 298 is satisfied (that is, if it is receiving the compressed air flow coming from the outlet port 4 of the lever-action valve 288), the pressure switch 298 transmits a low voltage (12-24 volt DC) signal through the electrical line 302 to open up the BCV 300, allowing high pressure compressed air, 120-150 PSIG, for instance) to enter the grit pot 296 to pick up the grit for grit blasting the tube. This grit-laden compressed air then flows into the reactor vessel 10 and to the nozzle 40, 40', or other grit blasting nozzle described herein.

The reader may note that, except for a short, low voltage electrical line 302 between the pressure switch 298 and the BCV 300, all the control lines in this embodiment are pneumatic lines. In the event that any of those pneumatic lines is accidentally severed, the flow of pressurized air to the pressure switch 298 will stop and the BCV 300 will be inactivated, stopping the flow of high pressure, grit-laden air to the nozzle 40, 40'. It also should be noted that the operator moves the lever 290 of the lever-action valve 288 to the off position before moving the grit blast arrangement 248 (See FIG. 38) so that, even if the proximity switch 292 of the plunger-action valve 291 is accidentally bumped and, coincidentally, the deadman switch 294 is also depressed at the same time, the flow of high pressure, grit-laden air to the nozzle 40, 40' (or other nozzle) is not activated.

It will be obvious to those skilled in the art that modifications may be made to the embodiments described above without departing from the scope of the invention as claimed.

What is claimed is:

1. A grit blasting device for cleaning tubes mounted perpendicular to top and bottom tubesheets, comprising:

a positioning frame;

a grit blast nozzle mounted on said positioning frame and projecting outwardly from said positioning frame, said grit blast nozzle defining a longitudinal axis and having an outlet to be directed into a tube opening of a tube during a cleaning operation;

a plurality of stop pins mounted on said positioning frame and projecting outwardly from said positioning frame, said stop pins having distal ends which define an imaginary plane;

wherein the grit blast nozzle is mounted on said positioning frame such that the longitudinal axis of said grit blast nozzle is defined relative and perpendicular to the imaginary plane defined by the distal ends of said stop pins;

wherein with the grit blasting device placed opposite a tubesheet of the top and bottom tubesheets during the cleaning operation, the imaginary plane is parallel with the tubesheet, the longitudinal axis of the grit blast nozzle is essentially coaxial with the tube, and the distal ends of the plurality of stop pins are configured to abut the tubesheet and prevent the outlet of the grit blast nozzle from extending into the tube; and wherein the outlet of said grit blast nozzle is configured to create a venturi effect at a juncture of the outlet and a first tube portion nearest the tube opening of the tube being cleaned, whereby the first portion of the tube is treated with grit blast material.

2. The grit blasting device for cleaning tubes mounted perpendicular to top and bottom tubesheets as recited in claim 1, and further comprising a control arrangement for controlling a flow of pressurized, grit-laden air to said grit blast nozzle, said control arrangement including at least one pneumatic valve and at least one pressure switch.

3. The grit blasting device for cleaning tubes mounted perpendicular to top and bottom tubesheets as recited in claim 2, and further comprising a base which supports said positioning frame, and a linear actuator which moves said positioning frame away from and toward said base.

4. The grit blasting device for cleaning tubes mounted perpendicular to top and bottom tubesheets as recited in claim 3, wherein said linear actuator is a pneumatic air slide.

5. The grit blasting device for cleaning tubes mounted perpendicular to top and bottom tubesheets as recited in claim 3, wherein said linear actuator defines a fully extended position and a retracted position.

6. The grit blasting device for cleaning tubes mounted perpendicular to top and bottom tubesheets as recited in claim 5, wherein, when said linear actuator is in the fully extended position, the grit blast nozzle is spaced away from the imaginary plane so as to leave a gap between the grit blast nozzle and the tube sheet when the imaginary plane is coplanar with the tube sheet.

7. The grit blasting device for cleaning tubes mounted perpendicular to top and bottom tubesheets as recited in claim 1, wherein the grit blast nozzle comprises a plurality of grit blast nozzles configured to matingly align, respectively, with a plurality of tubes during the tube cleaning operation.

8. The grit blasting device for cleaning tubes mounted perpendicular to top and bottom tubesheets as recited in claim 1, wherein the positioning frame comprises a cup having a plurality of wings surrounding the outlet of the grit blast nozzle.

9. The grit blasting device for cleaning tubes mounted perpendicular to top and bottom tubesheets as recited in claim 8, wherein the cup and wings are configured to enhance a venturi effect when grit material is introduced into the tube during the cleaning operation.

10. The grit blasting device for cleaning tubes mounted perpendicular to top and bottom tubesheets as recited in claim 1, wherein the positioning frame includes an electrical insulator.

11. The grit blasting device for cleaning tubes mounted perpendicular to top and bottom tubesheets as recited in claim 1, wherein the grit blast nozzle comprises a plurality of grit blast nozzles with each grit blast nozzle having a cup surrounding a nozzle outlet and each cup having a plurality of wings surrounding the outlet of the respective grit blast nozzle.

12. The grit blasting device for cleaning tubes mounted perpendicular to top and bottom tubesheets as recited in claim 1, further comprising one or more LED lights proximate one or more of the plurality of stop pins.

* * * * *